US008150296B2

(12) United States Patent
Sakurai et al.

(10) Patent No.: US 8,150,296 B2
(45) Date of Patent: Apr. 3, 2012

(54) COLOR ELECTROPHOTOGRAPHIC IMAGE FORMING APPARATUS WITH MANUALLY-OPERATED UNIT

(75) Inventors: Hiromi Sakurai, Suntou-gun (JP); Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 675 days.

(21) Appl. No.: 12/266,134

(22) Filed: Nov. 6, 2008

(65) Prior Publication Data

US 2010/0054814 A1 Mar. 4, 2010

(30) Foreign Application Priority Data

Aug. 28, 2008 (JP) ..... 2008-219387

(51) Int. Cl.
*G03G 15/01* (2006.01)

(52) U.S. Cl. ..... 399/227

(58) Field of Classification Search ..... 399/227
See application file for complete search history.

(56) References Cited

U.S. PATENT DOCUMENTS

| | | | | |
|---|---|---|---|---|
| 4,421,401 | A | 12/1983 | Kaguira et al. | |
| 5,666,613 | A * | 9/1997 | Kumon et al. | 399/227 |
| 5,862,430 | A * | 1/1999 | Mitekura et al. | 399/13 |
| 6,023,599 | A * | 2/2000 | Matsuzaka et al. | 399/227 |
| 6,122,469 | A * | 9/2000 | Miura et al. | 399/227 |
| 7,386,252 | B2 * | 6/2008 | Portig et al. | 399/110 |
| 2004/0101330 | A1 * | 5/2004 | Gumbe | 399/227 |
| 2006/0188291 | A1 * | 8/2006 | Kawakami et al. | 399/167 |
| 2008/0286010 | A1 | 11/2008 | Aoki et al. | |
| 2008/0286011 | A1 | 11/2008 | Aoki et al. | |

FOREIGN PATENT DOCUMENTS

| | | | |
|---|---|---|---|
| JP | 3-4245 A | | 1/1991 |
| JP | 6-250485 A | | 9/1994 |
| JP | 6-317965 A | | 11/1994 |
| JP | 06317965 A | * | 11/1994 |
| JP | 10-142886 A | | 5/1998 |
| JP | 10-239942 A | | 9/1998 |
| JP | 2004-138776 A | | 5/2004 |
| JP | 2006-153220 A | | 6/2006 |

OTHER PUBLICATIONS

Machine translation of JP 06317965 A.*
Japanese Office Action dated Dec. 24, 2008 in Japanese Application No. 2008-219387, and an English-language translation thereof.
Search Report dated Feb. 10, 2010, in counterpart European Application No. 08170735.8-1240/2159651.
Notification of the First Office Action dated Jul. 26, 2011, in counterpart Chinese Application No. 200810184368.2.

* cited by examiner

*Primary Examiner* — David Gray
*Assistant Examiner* — David Bolduc
(74) *Attorney, Agent, or Firm* — Fitzpatrick, Cella, Harper & Scinto

(57) ABSTRACT

In an image forming apparatus including a rotary member (15) to which a plurality of developing cartridges (B, Y, M, C) (16) are detachably mountable, a user can rotate the rotary member with an easy operation to access the plurality of developing cartridges. A pivotable unit (63) is contactable and separable from a driving train for the rotary member (15). By applying a certain braking force to a pivotal gear (69), the pivotal gear (69) is moved to a position at which the pivotal gear (69) is held in contact with the driving train by a user's operational force. In association with the contact movement of the pivotable unit (63), a solenoid (57) performing a positional control of the rotary member (15) is released.

8 Claims, 15 Drawing Sheets

COLOR ELECTROPHOTOGRAPHIC IMAGE FORMING APPARATUS WITH MANUALLY-OPERATED UNIT

BACKGROUND OF THE INVENTION

1. Field of the Invention

The present invention relates to a color electrophotographic image forming apparatus.

2. Description of the Related Art

There is known a developing device of a rotary type in a color electrophotographic image forming apparatus. In the developing device of the rotary type, a plurality of developing cartridges each containing developer of a different color from each other are supported around a rotary member. Then, a rotative force from a motor is transmitted to the rotary member through a rotative force transmitting means. With this structure, the rotary member is allowed to rotatably move. In the developing device of the rotary type, one of the developing cartridges is moved to a developing position in which the developing cartridge is opposed to a photosensitive drum. Then, an electrostatic latent image formed on the photosensitive drum is developed with use of the developer by the developing cartridge. Further, this operation is performed on the plurality of developing cartridges, whereby a color image is formed on a recording medium.

In the image forming apparatus adopting the developing device of the rotary type, a color image may be formed with use of a small photosensitive drum. Thus, an apparatus main body is advantageously downsized.

Then, a user detachably mounts the developing cartridges to the rotary member. With this structure, the operability in a case of maintenance may be improved.

In this case, there is known a structure in which the developing cartridges are moved by hand to the replacement position provided in the apparatus main body. Specifically, with rotation of a knob by hand, the developing cartridge switching mechanism may be rotated. As a result, the developing cartridge may be positioned to the replacement port by hand (refer to Japanese Patent Application Laid-Open No. H06-250485). With this structure, the operability in replacing the developing cartridge may be improved.

However, in the above-mentioned conventional example, it is conceived that the knob becomes a rotation load when the developing cartridge switching mechanism is rotated by the motor.

SUMMARY OF THE INVENTION

The present invention has been made with an aim to further develop the conventional technology.

It is an object of the present invention to provide a color electrophotographic image forming apparatus capable of moving a desired developing cartridge to a mounting and detaching position by manual operation by a user.

It is another object of the present invention to provide a color electrophotographic image forming apparatus capable of moving a desired developing cartridge to a mounting and detaching position by easy manual operation by a user.

It is another object of the present invention to provide a color electrophotographic image forming apparatus capable of moving a manually-operated unit from a retracted position to an operative position when an operational force is exerted on the manually-operated unit by manual operation.

It is another object of the present invention to provide a color electrophotographic image forming apparatus capable of exerting a rotative force on a rotary member to which a developing cartridge is mounted as a manually-operated unit is moved from a retracted position to an operative position when an operational force is exerted on the manually-operated unit by manual operation.

It is another object of the present invention to provide a color electrophotographic image forming apparatus in which, when a rotary member is rotated by a rotative force of a motor, a manually-operated unit normally locates at a retracted position so that the manually-operated unit does not become a load for rotation.

It is another object of the present invention to provide a color electrophotographic image forming apparatus in which a manually-operated unit can be moved to a position at which the manually-operated unit is connected to rotative force transmitting means without a special operation by a user, and an operational force can be transmitted to a rotary.

It is another object of the present invention to provide a color electrophotographic image forming apparatus in which, during a rotation of a motor, a manually-operated unit does not become a load for rotation.

In order to achieve the above-mentioned objects, a representative structure of a color electrophotographic image forming apparatus according to the present invention is a color electrophotographic image forming apparatus, comprising: an electrophotographic photosensitive drum; a motor; a rotatable rotary member to which a plurality of developing cartridges are detachably mountable, each developing cartridge including: a developer containing portion for containing developer; and a developing roller for developing an electrostatic latent image formed on the electrophotographic photosensitive drum by using the developer contained in the developer containing portion; rotative force transmitting means for transmitting a rotative force from the motor to the rotary member; and a manually-operated unit, which is movable between an operative position in which the manually-operated unit is connected to the rotative force transmitting means to transmit the rotative force to the rotative force transmitting means and a retracted position in which the manually-operated unit is spaced apart from the rotative force transmitting means, wherein in a state in which the manually-operated unit is moved from the retracted position to the operative position by manual operation, the manually-operated unit transmits the rotative force to the rotative force transmitting means by manual operation to rotate the rotary member, whereby the rotary member is rotatable by the manual operation.

In order to achieve the above-mentioned objects, another representative structure of a color electrophotographic image forming apparatus according to the present invention is a color electrophotographic image forming apparatus, comprising: an electrophotographic photosensitive drum; a motor; a rotatable rotary member to which a plurality of developing cartridges are detachably mountable, each developing cartridge including: a developer containing portion for containing developer; and a developing roller for developing an electrostatic latent image formed on the electrophotographic photosensitive drum by using the developer contained in the developer containing portion, wherein the rotary member sequentially moves one developing cartridge among the plurality of developing cartridges to a developing position for developing the electrostatic latent image formed on the electrophotographic photosensitive drum; an opening portion through which the developing cartridge is mounted and detached from the rotary member; an openable and closable member for opening and closing the opening portion; rotative force transmitting means for transmitting a rotative force from the motor to the rotary member to rotate the rotary member; and a manually-operated unit including an access member provided in a position in which the access member is operable from the opening portion in a state in which the openable and closable member is opened to open the opening portion, wherein the manually-operated unit is movable between an operative position in which the manually-operated unit is in contact with the rotative force transmitting means to transmit an operational force to the rotary member and a retracted position in which the manually-operated unit is spaced apart from the rotative force transmitting means, and wherein when the access member is manually operated to exert the operational force, the manually-operated unit is moved from the retracted position to the operative position, whereby the rotative force is exerted on the rotary member.

According to an embodiment of the invention, a user can move a desired developing cartridge to a mounting and detaching position by manual operation.

According to an embodiment of the invention, a user can move a desired developing cartridge to a mounting and detaching position by easy manual operation.

According to an embodiment of the invention, a user can move a manually-operated unit from a retracted position to an operative position when the user exerts an operational force on the manually-operated unit by manual operation.

According to an embodiment of the invention, a user can exert a rotative force on a rotary member to which a developing cartridge is mounted as a manually-operated unit is moved from a retracted position to an operative position when an operational force is exerted on the manually-operated unit by manual operation.

According to an embodiment of the invention, when a rotary member is rotated by a rotative force of a motor, a manually-operated unit normally locates at a retracted position so that the manually-operated unit does not become a load for rotation.

According to an embodiment of the invention, a manually-operated unit can be moved to a position at which the manually-operated unit is connected to rotative force transmitting means without a special operation by a user, and an operational force can be transmitted to a rotary.

According to an embodiment of the invention, during a rotation of a motor, a manually-operated unit does not become a load for rotation.

Further features of the present invention will become apparent from the following description of exemplary embodiments with reference to the attached drawings.

DESCRIPTION OF THE EMBODIMENTS

In the following, embodiments of the present invention are described with reference to the attached drawings.

First Embodiment

Entire Structure of Color Electrophotographic Image Forming Apparatus

Figure 1:
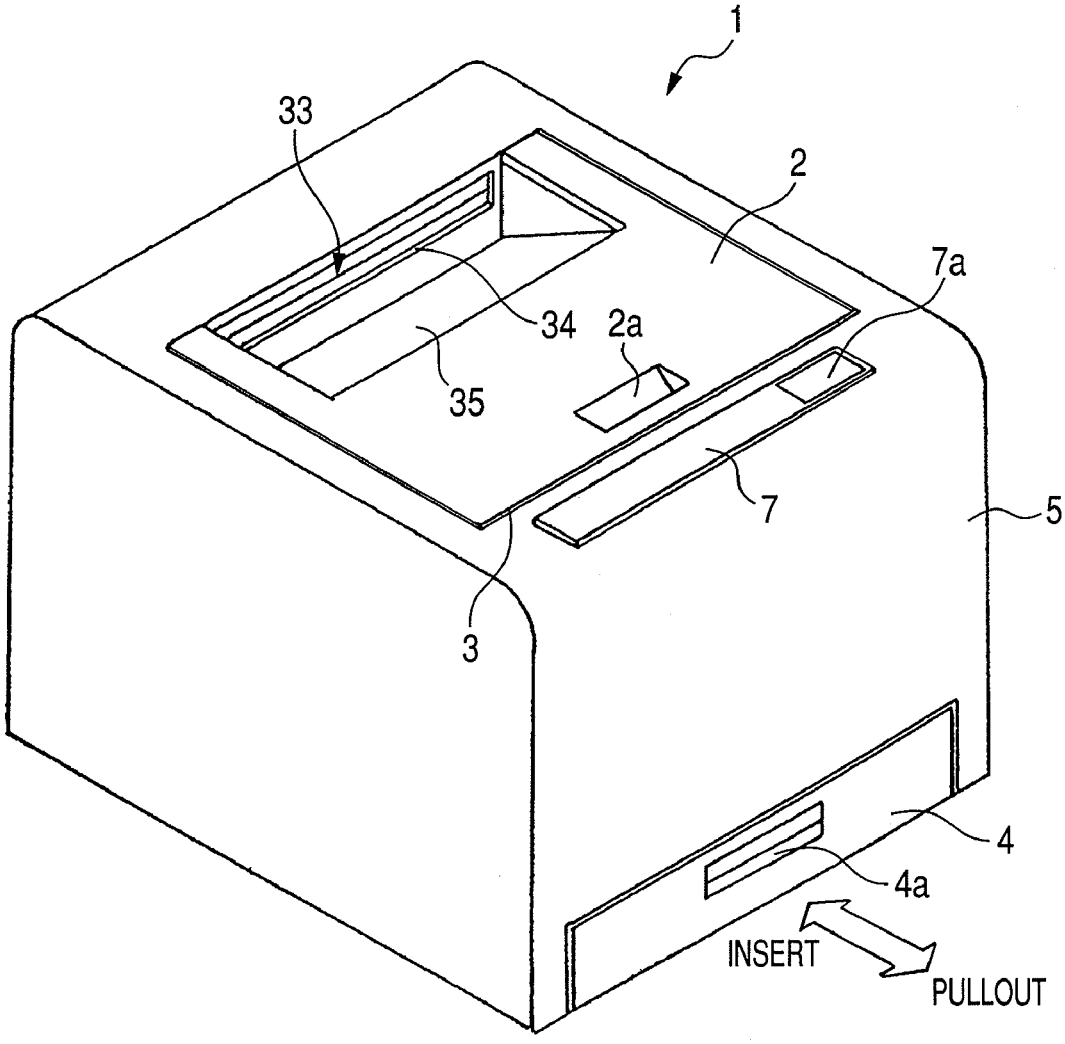
FIG. 1 is a perspective model view illustrating an outward appearance of an image forming apparatus according to an embodiment of the present invention.
Figure 2:
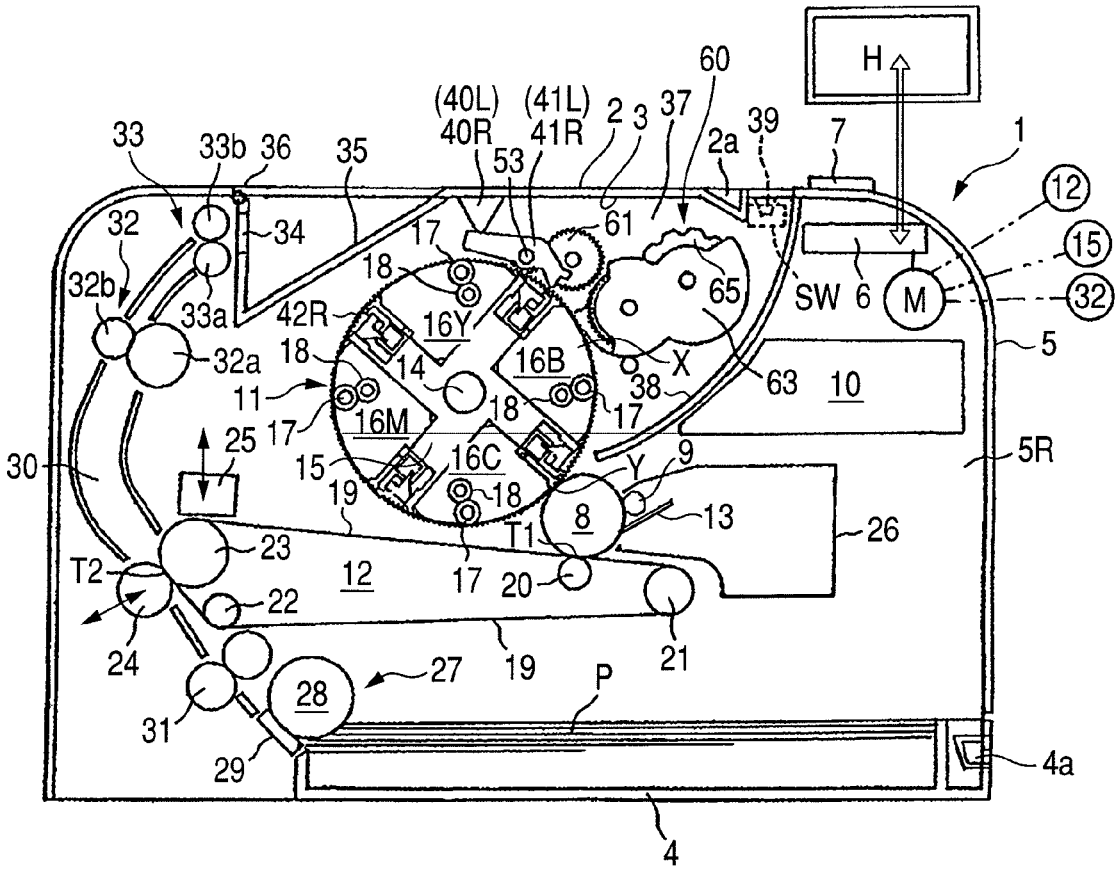
FIG. 2 is a left-side vertical sectional model view of the image forming apparatus.
Figure 3:
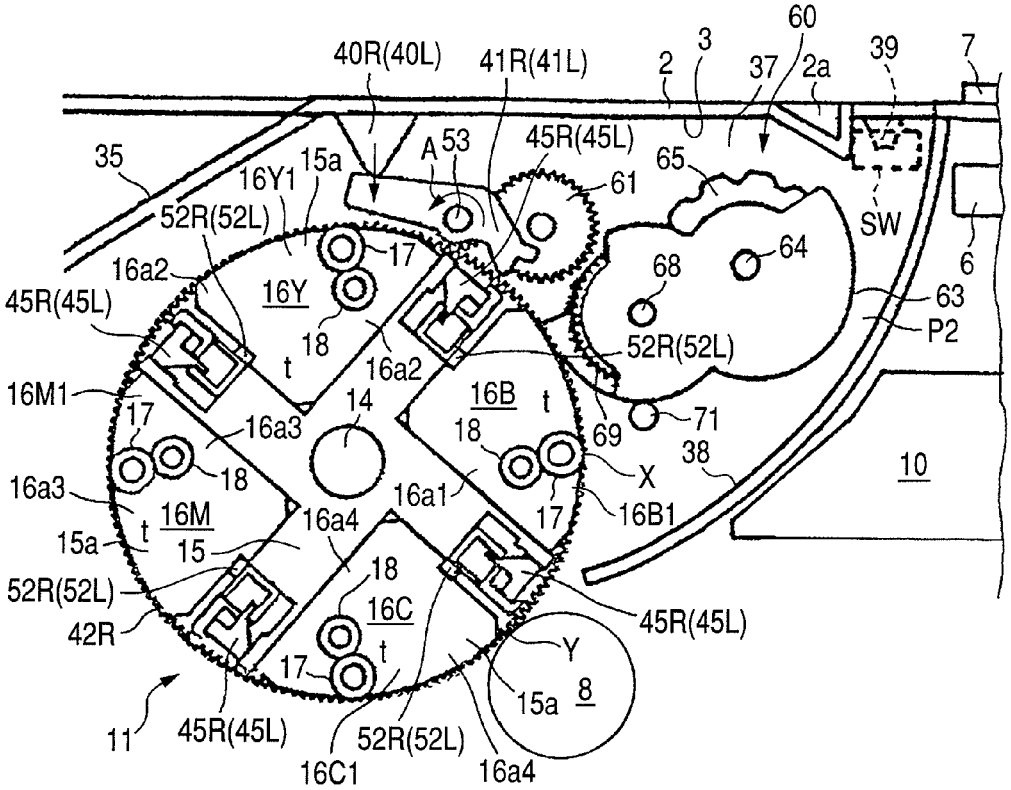
FIG. 3 is a partial enlarged view of FIG. 2.
Figure 4:
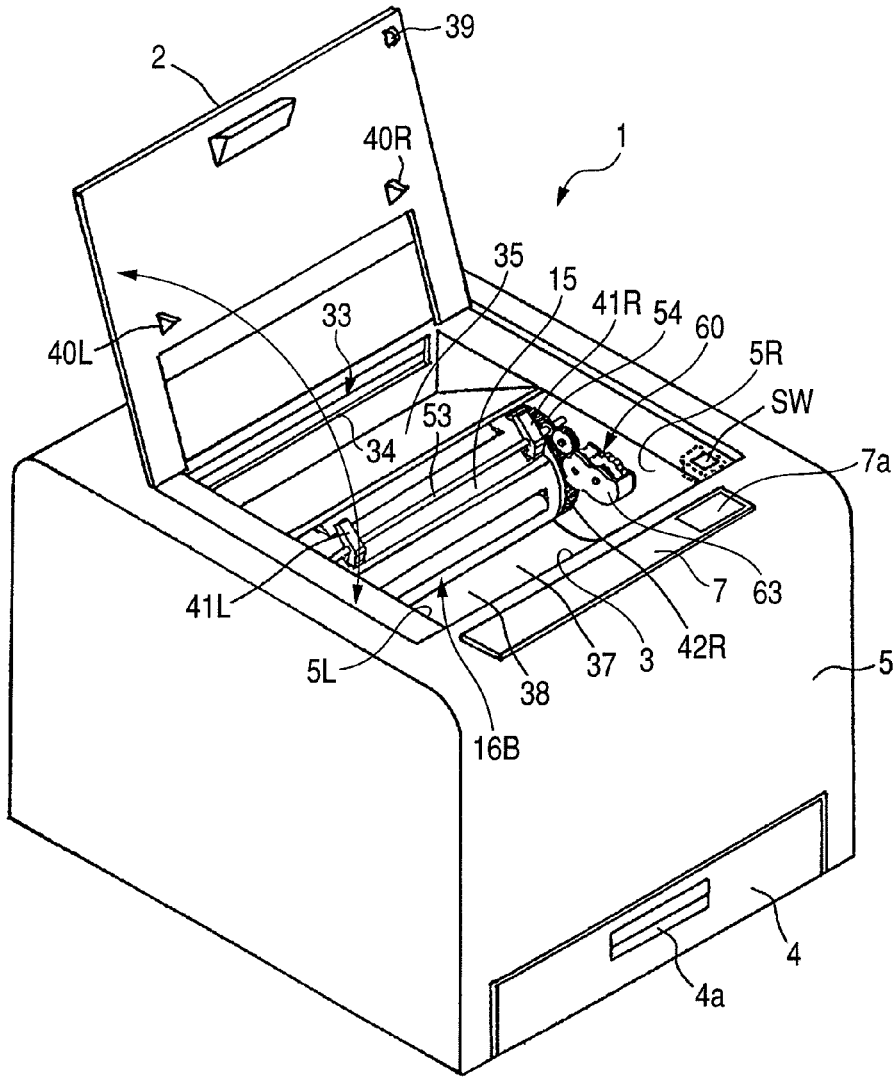
FIG. 4 is a perspective model view illustrating an outward appearance of the image forming apparatus in a state in which an upper surface cover is opened.
Figure 5:
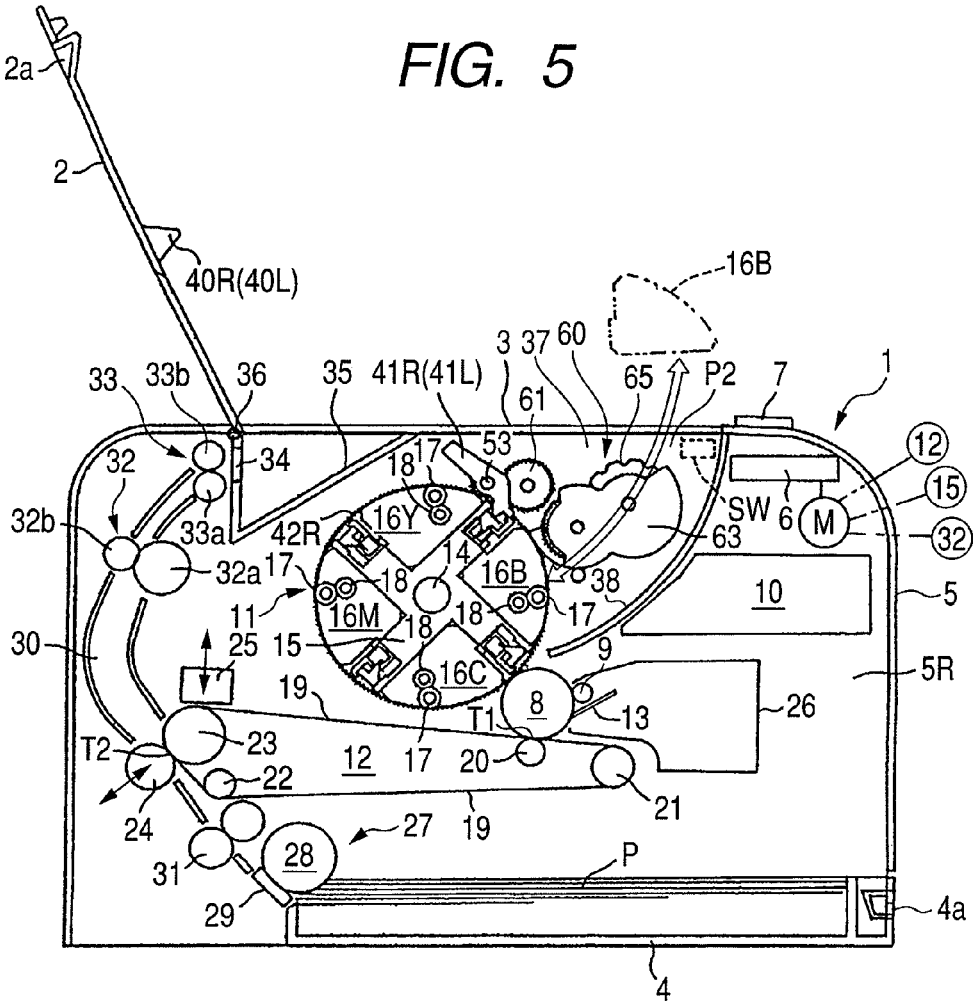
FIG. 5 is a left-side vertical sectional model view of the image forming apparatus in the state in which the upper surface cover is opened.
Figure 6:
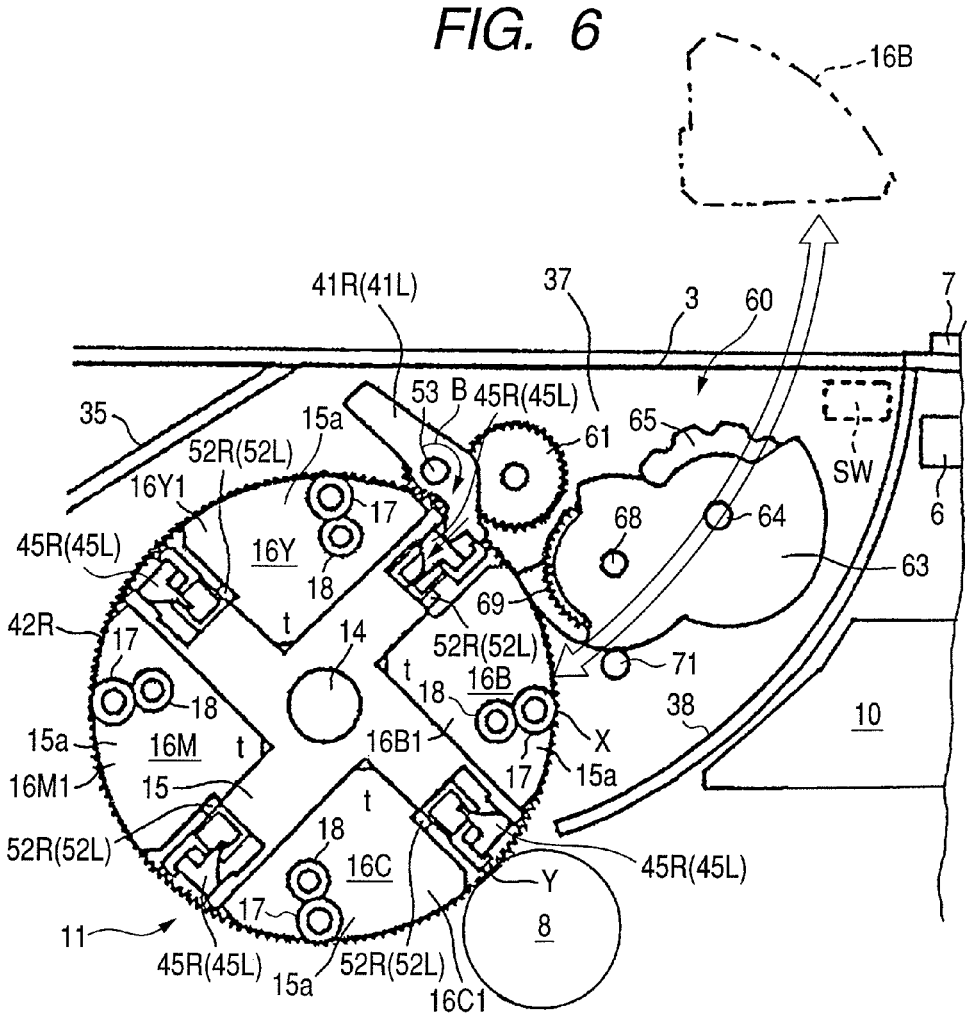
FIG. 6 is a partial enlarged view of FIG. 5.

FIG. 1 is a perspective view illustrating an outward appearance of a color electrophotographic image forming apparatus 1 according to this embodiment of the present invention. FIG. 2 is a left-side vertical sectional model view of the color electrophotographic image forming apparatus 1. FIG. 3 is a partially enlarged view of FIG. 2. FIG. 4 is a perspective view illustrating an outward appearance of the image forming apparatus 1 in a state in which an upper surface cover (openable and closable member) 2 is opened so that an opening portion 3 is opened for mounting and detaching a developing cartridge. FIG. 5 is a left-side vertical sectional model view of the image forming apparatus 1 in the state in which the cover 2 is opened. FIG. 6 is a partially enlarged view of FIG. 5.

In the following description of the image forming apparatus 1, the front side (front surface side) represents a side on which a cassette 4 for recording media is inserted and pulled out. The rear side thereof represents a side opposite thereto. The front-back direction represents a direction (front direction) from the rear side toward the front side of the apparatus and a direction (back direction) opposite thereto. The left and right represent the left or the right as viewed from the front surface of the apparatus. The left-and-right direction represents a direction (left direction) from the right toward the left and a direction (right direction) opposite thereto. Further, one end side in the longitudinal direction (axial direction) of an electrophotographic photosensitive drum 8 is a driving side, and the other end side thereof is a non-driving side. Still further, an apparatus main body 5 represents the portion except for the developing cartridges of the image forming apparatus.

The image forming apparatus 1 forms an image on the recording medium with use of an electrophotographic process. Note that the image forming apparatus 1 used in this embodiment includes a color laser printer which is capable of forming a full color image on the recording media. Further, the recording media represent media on which images are formed by the image forming apparatus, which includes sheets of paper, OHP sheets, and labels.

The apparatus 1 performs image formation on sheet-like recording media P on the basis of an electrical image signal input to a control circuit portion (control means: CPU) 6 from an external host device H such as a personal computer, an image reader, and a facsimile machine. The circuit portion 6 exchanges various types of electrical information together with the host device H and an operating portion 7 provided on the front side of the upper surface of the apparatus main body 5, and collectively controls the image forming operation of the apparatus 1 on the basis of a predetermined control program and a look-up table. Note that a motor M described later is also controlled on the basis of the electrical signal from the circuit portion 6.

Inside the apparatus main body 5, the electrophotographic photosensitive drum 8 (hereinafter, simply referred to as drum) is rotatably disposed between a left frame (left plate) 5L and a right frame (right plate) 5R constituting a framework of the apparatus main body 5, with the axial direction thereof being the left-and-right direction. Further, charging means 9, image exposure means 10, developing means 11, transfer means 12, and drum cleaning means 13 are arranged around the drum 8.

The charging means 9 uniformly charges the surface of the drum 8 to a predetermined polarity and potential. A charging roller is used as the charging means in this embodiment.

The image exposure means 10 forms an electrostatic latent image on the surface of the drum 8. A laser scanner unit is used as the image exposure means in this embodiment. The laser scanner unit 10 outputs a laser beam L (FIG. 7) modulated correspondingly to image information of various colors, which is input to the circuit portion 6 from the host device H, so as to scan and expose the drum surface.

The developing means 11 develops an electrostatic latent image formed on the drum 8 into a developer image. The developing means 11 according to this embodiment is a rotary developing device. The developing means 11 includes a rotary (rotary member or rotary support member) 15, a plurality of developing cartridges 16 detachably mounted around the rotary 15, and a rotary electrically-driving mechanism (FIGS. 11A, 11B and 11C: rotative force transmitting means) 55 for electrically indexing the rotary 15. That is, the developing device 11 includes the rotary 15 which is capable of indexing around a central shaft 14 rotatably bearing-supported between the left and right frames 5L and 5R of the apparatus main body 5. Further, the developing device 11 includes the plurality of developing cartridges 16 (16B, 16Y, 16M and 16C) detachably mounted around the rotary 15. In this embodiment, first-to-fourth or four developing cartridges 16B, 16Y, 16M and 16C are provided. The rotary 15 is capable of retaining the four cartridges 16 in a substantially columnar manner. Further, the cartridges 16 are mounted to the rotary 15 at intervals of 90° in the rotation direction of the rotary 15.

Each of the cartridges 16 includes a developing roller 17 and a developer supply roller 18 for supplying a developer "t" to the developing roller 17, and respectively includes developer containing portions 16B1, 16C1, 16M1 and 16Y1 (FIGS. 3 and 6) which contain the developers "t". Further, the cartridges 16 are detachably mounted by a user to corresponding holding portions 44 (44B, 44Y, 44M and 44C: FIGS. 8A, 8B, 9A and 9B) provided to the rotary 15. That is, the cartridges 16 may be mounted to and detached from the holding portions 44 by a user. Note that the developer "t" of black (B) color is contained in the developer containing portion 16B1 of the first developing cartridge 16B. The developer "t" of yellow (Y) color is contained in the developer containing portion 16Y1 of the second developing cartridge 16Y. The developer "t" of magenta (M) color is contained in the developer containing portion 16M1 of the third developing cartridge 16M. The developer "t" of cyan (C) color is contained in the developer containing portion 16C1 of the fourth developing cartridge 16C.

As described above, a plurality of developing cartridges (16Y, 16M, 16C and 16B) are detachably mounted to the rotary 15. The developing cartridges include the developer containing portions (16B1, 16C1, 16M1 and 16Y1) which contain the developer "t", respectively. Further, each of the developing cartridges includes the developing roller 17 for developing an electrostatic latent image formed on the photosensitive drum 8 with use of the developers "t" respectively contained in the developer containing portions (16B1, 16C1, 16M1, and 16Y1). In addition, the rotary 15 is rotated. As described later, the rotary 15 sequentially moves one developing cartridge among the plurality of developing cartridges to a developing position at which the electrostatic latent image formed on the drum 8 is developed.

The transfer means 12 transfers a developer image formed on the surface of the drum 8 onto the recording medium P. An intermediate transfer belt unit 12 is used as the transfer means in this embodiment. The unit 12 includes an endless intermediate transfer belt (hereinafter, simply referred to as belt) 19 which is made of a dielectric material and flexible, and serves as an intermediate transfer member. The unit 12 includes a primary transfer roller 20, a belt driving roller 21, a tension roller 22, and a secondary transfer opposite roller 23 around which the belt 19 is passed under tension. The transfer roller 20 is held in pressure contact with the drum 8 while nipping the belt 19 therebetween. The contact portion between the drum 8 and the belt 19 serves as a primary transfer nip portion T1.

A secondary transfer roller 24 is disposed opposite to the belt wrapped portion of the roller 23. By a pivotal mechanism (not shown), the roller 24 is moved to the operative position at which the roller 24 is held in contact with the roller 23 while nipping the belt 19 therebetween, and to the inoperative position at which the roller 24 is spaced apart from the surface of the belt 19. Note that the transfer roller 24 is normally held in the inoperative position, and is moved to the operative position at a predetermined controlled timing. In a state in which the roller 24 is moved to the operative position, the contact portion between the roller 24 and the belt 19 serves as a secondary transfer nip portion T2.

Further, in the belt wrapped portion of the roller 23, a belt cleaner 25 for cleaning the surface of the belt 19 is disposed downstream of the roller 24 in the moving direction of the belt 19. The cleaner 25 is moved between an operative position at which a cleaning member (not shown) is held in contact with the surface of the belt 19 by the pivotal mechanism (not shown) and an inoperative position at which the cleaning member is separated from the surface of the belt 19. Note that the cleaning member is normally held in the inoperative position, and is moved to the operative position at a predetermined controlled timing.

The drum cleaning means 13 removes after-primary-transfer residual developer from the surface of the drum 8 from which the developer image has been primarily transferred onto the belt 19. In this embodiment, a cleaning blade is used as the drum cleaning means 13. The cleaning blade is held in contact with the surface of the drum 8 so as to remove the residual developer. Note that the developer removed from the surface of the drum 8 is collected in a cleaner container 26.

A feeding unit 27 is disposed below the belt unit 12. The unit 27 includes the cassette 4 which contains the recording media P, a pickup roller 28 and a separation pad 29. The cassette 4 is freely put in and out on the front surface side of the apparatus main body 5 (front loading). Note that a pull portion 4*a* is provided on the front surface of the cassette 4.

A conveying path 30 is provided from bottom to top on the rear side in the apparatus main body 5. The conveying path 30 is provided from bottom to top with a registration roller unit 31, the secondary transfer roller 24, a fixing unit 32, and a delivery unit 33. The fixing unit 32 includes a fixing roller 32*a* and a pressure roller 32*b*. The delivery unit 33 includes a delivery roller 33*a* and a roller 33*b*. A delivery tray 35 is provided on the upper surface of the apparatus main body 5. Further, the upper surface cover 2 which is openable and closable about a hinge shaft 36 as a center is provided on the upper surface of the apparatus main body 5. A pull portion 2*a* is provided on the cover 2. In a state of being closed to the apparatus main body 5 (FIGS. 1, 2 and 3), the cover 2 is continuous with the delivery tray 35 so as to function as an extended tray of the delivery tray 35. The recording media P subjected to image formation are delivered from an outlet 34 to the delivery tray 35 and the cover 2 by the delivery unit 33.

An opening portion 3 for performing mounting and detaching of the cartridges 16 with respect to the rotary 15 of the developing device 11 is provided in the upper surface of the apparatus main body 5. When mounting the cartridges 16 to the rotary 15 (holding portions 44) or detaching the cartridges 16 from the rotary 15 (holding portions 44), a user passes the cartridge 16 through the opening portion 3 while gripping the cartridge 16. That is, the opening portion 3 is provided for allowing the cartridges 16 to be mounted to and detached from the rotary 15. Note that the opening portion 3 is provided on the front side with respect to the delivery tray 35. The cover 2 can rotate about the hinge shaft 36 as a center to assume a closed state in which the opening portion 3 is closed and an opened state in which the opening portion 3 is opened. That is, the cover 2 is capable of opening and closing the opening portion 3. The cover 2 is normally closed, and is opened by a user when the cartridges 16 are mounted and detached (FIGS. 4, 5 and 6). When the cover 2 is opened, the opening portion 3 provided on the upper surface of the apparatus main body 5 is opened. Then, a cartridge mounting/detaching path portion 37 is visible which communicates the opening portion 3 with the developing device 11 in the apparatus main body 5. The path portion 37 includes a guide plate 38 which is disposed between the opening portion 3 and the developing device 11 and curved in a shape of a concave arc surface. The path portion 37 is disposed above the drum 8.

Further, in association with the opening and closing of the cover 2, an interlock switch (kill switch) SW of a power supply circuit (not shown) of the apparatus is turned ON and OFF. That is, when the cover 2 is closed, a first protruding portion 39 provided on the under side surface of the cover 2 presses an actuator of the interlock switch SW provided on the apparatus main body 5 side. As a result, a switched-on state of the switch SW and a turned-on state of the power supply circuit are maintained. When the cover 2 is opened, the protruding portion 39 is retracted so as to release the pressing of the actuator by the protruding portion 39. As a result, a switched-off state of the switch SW and a turned-off state of the power supply circuit are maintained, and the driving of the apparatus main body 5 is released.

Still further, on the backside surface of the cover 2, second protruding portions 40L and 40R are provided on the one end side and the other end side in the longitudinal direction of the cover 2, respectively. Meanwhile, engagement releasing members 41L and 41R are provided on the one end side and the other end side in the longitudinal direction of the rotary 15 (FIGS. 2, 3, 4, 5, 6, 7, 8A and 8B). Further, in association with the opening and closing of the cover 2, the engagement releasing members 41L and 41R are pivoted between the cartridge engagement position and the cartridge engagement releasing position with respect to the rotary 15. That is, when the cover 2 is opened, this is described later.

An operation for forming a full color image is performed as follows. FIGS. 2 and 3 illustrate a standby state of the image forming apparatus 1. The cover 2 is closed. The rotary 15 is maintained in a state in which the rotation thereof is stopped while the first developing cartridge 16B for black color is at a rotational angular position corresponding to the path portion 37 as a standby position X. Note that the standby position X (position illustrated in FIGS. 2 and 3, for example) is displaced with respect to a developing position Y (position illustrated in FIG. 7, for example) by a predetermined angular phase. Further, the standby position X is a mounting and detaching position at which a desired developing cartridge 16 is mounted and detached with respect to the rotary 15.

Figure 7:
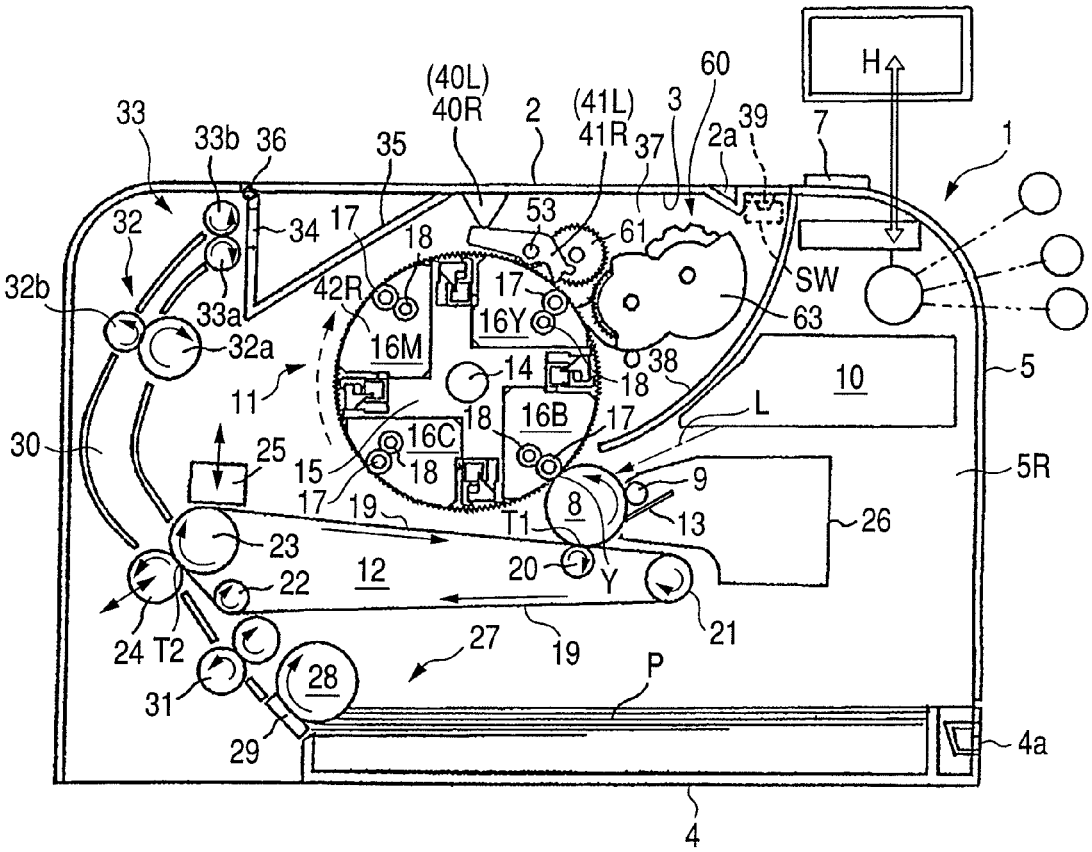
FIG. 7 is an explanatory view of an image forming operation of the image forming apparatus.

The control circuit portion 6 is ready to input of an image formation start signal in the standby state. The circuit portion 6 drives the motor M (FIGS. 2, 11B and 11C, for example) when the image formation start signal is input thereto. By the rotary electrically-driving mechanism (described later) to which the rotative force of the motor M is transmitted, the rotary 15 is rotated clockwise about the central shaft 14 by 45° in this embodiment from the standby position X (FIG. 2), and then stops the rotation thereof. That is, as a result of the rotation of the rotary 15, the developing cartridge 16B is moved from the standby position X corresponding to the path portion 37 to the developing position Y at which the developing roller 17 of the developing cartridge 16B is opposed to the drum 8 (FIG. 7). As described later, the cartridge driving force is transmitted from the apparatus main body 5 to the developing cartridge 16B. Further, a predetermined developing bias is supplied from the apparatus main body 5. With the cartridge driving force, the drum 8 is rotated counterclockwise (as illustrated by an arrow of FIG. 7) at a predetermined speed. The scanner unit 10 is driven as well. The belt 19 is drive-rotated clockwise as well (as illustrated by the arrows of FIG. 7) (in the forward direction with respect to the rotation direction of drum 8) at a speed corresponding to the speed of the drum 8. Each of the transfer roller 24 and the belt cleaner 25 is moved to the inoperative position which is separated from the belt 19. A predetermined charging bias is applied to the charging roller 9 from the apparatus main body 5. As a result, the surface of the rotating drum 8 is uniformly charged to a predetermined polarity and potential. From the scanner unit 10, the laser beam L modulated correspondingly to a B color component image signal of a full color image is output so that the drum surface is scanned and exposed. As a result, an electrostatic latent image corresponding to a B color component image is formed on the surface of the drum 8. The electrostatic latent image is developed as a developer image of B color by the cartridge 16B. That is, the electrostatic latent image formed to the drum 8 is developed by the developing roller 17. In this embodiment, the electrostatic latent image is reversely developed with use of the negative developer having the same polarity as the charging polarity of the drum 8. The developer image of B color is primarily transferred to the surface of the belt 19 at the primary transfer nip portion T1. A primary transfer bias having a reverse polarity to the charging polarity of the developer and a predetermined potential is applied to the transfer roller 20 at a predetermined controlled timing. The surface of the drum 8 after the primary transfer is cleaned by the cleaning blade 13.

When the primary transfer of the developer image of B color onto the belt 19 is completed, the rotary 15 is intermittently rotated clockwise by 90°. As a result, the cartridge 16Y for yellow is sequentially moved to the developing position Y opposed to the drum 8. Then, processes of charging, exposure, and development with respect to the drum 8 are executed for forming a developer image of Y color corresponding to the Y color component image of a full color image. The developer image of Y color formed in the above-mentioned processes is primarily transferred at the nip portion T1 so as to be superposed on the developer image of B color which has already transferred onto the belt 19.

When the primary transfer of the developer image of Y color onto the belt 19 is completed, the rotary 15 is rotated clockwise by 90°. As a result, the cartridge 16M for magenta is sequentially moved to the developing position Y. Then, processes of charging, exposure, and development with respect to the drum 8 are executed for forming a developer image of M color corresponding to the M color component image of a full color image. The developer image of M color formed in the above-mentioned processes is primarily transferred at the nip portion T1 so as to be superposed on the developer images of B color and Y color which have already transferred onto the belt 19.

When the primary transfer of the developer image of M color onto the belt 19 is completed, the rotary 15 is rotated clockwise by 90°. As a result, the cartridge 16C for cyan is sequentially moved to the developing position Y. Then, processes of charging, exposure, and development with respect to the drum 8 are executed for forming a developer image of C color corresponding to the C color component image of a full color image. The developer image of C color formed in the above-mentioned processes is primarily transferred at the nip portion T1 so as to be superposed on the developer images of B color, Y color, and M color which have already transferred onto the belt 19.

As described above, an unfixed full-color developer image of four colors consisting of B color, Y color, M color and C color is synthetically formed on the belt 19.

That is, by the rotary electrically-driving mechanism (rotative force transmitting means) 55 described later, the rotary 15 is indexed so that a predetermined developing cartridge 16 of the plurality of developing cartridges 16 is moved to the developing position Y. Then, with use of the cartridge 16 positioned at the developing position Y, the latent image formed on the drum 8 is developed as a developer image. The plurality of cartridges 16 are sequentially subjected to this operation so that a color image is formed on the recording medium P.

Note that the successive formation of color developer images with respect to the drum 8 is not necessarily performed in the color order of B color, Y color, M color, and C color as in this embodiment, but may be performed in an appropriate color order.

Then, the leading edge of the unfixed full-color developer image of four colors formed on the belt 19 reaches the position of the transfer roller 24 in accordance with the movement of the belt 19 after the transfer roller 24 is moved to the operative position of being held in contact with the belt 19. Further, the belt cleaner 25 is moved to the operative position with respect to the belt 19 as well.

Meanwhile, the pickup roller 28 is driven at a predetermined controlled timing. As a result, through cooperation between the roller 28 and the separation pad 29, one of the sheet-like recording media P contained in a stacked manner in the cassette 4 is separated therefrom so as to be fed. The recording medium P is led into the secondary transfer nip portion T2 as a contact portion of the transfer roller 24 with the belt 19 by the registration roller unit 31 at a predetermined controlled timing. A secondary transfer bias having a reverse polarity to the charging polarity of the developer is applied to the transfer roller 24. In this manner, in the process of nipping and conveying the recording medium P at the nip portion T2, four-color superposed developer images on the belt 19 are collectively and secondarily transferred to the surface of the recording medium P.

The recording medium P is separated from the surface of the belt 19 so as to be led into the fixing unit 32, and then heated and pressurized at the fixing nip portion. As a result, the developer images of each color are fixed (fused and mixed of colors) to the recording medium P. Then, the recording medium P passes the fixing unit 32 and is delivered as full color image formation through the outlet 34 onto the delivery tray 35 and the cover 2 by the delivery unit 33.

After the recording medium P is separated, untransferred developer which remains on the surface of the belt 19 is removed by the belt cleaner 25.

When the image forming job for one or a plurality of successive sheets is completed, the circuit portion 6 causes the image forming apparatus 1 to enter the standby state. Then, the circuit portion 6 is ready to input a next image formation start signal. That is, the drum 8, the scanner unit 10, the belt 19, and the like are stopped from being driven. Further, the transfer roller 24 and the belt cleaner 25 are moved to the inoperative positions. Then, the rotary 15 is rotated by 45° and stopped while the cartridge 16B for black is returned to the standby position X (FIGS. 2 and 3) which corresponds to the path portion 37. That is, the circuit portion 6 stops the rotary 15 such that the developing cartridge 16B is positioned at the standby position X.

In the case of a monochrome image formation mode, only the image formation with use of the cartridge 16B is performed. When the monochrome image forming job for one or a plurality of successive sheets is completed, the circuit portion 6 returns the image forming apparatus 1 to the above-mentioned standby state. Then, the circuit portion 6 is ready to input of a next image formation start signal.

(Developing Device 11)

Figure 8A:
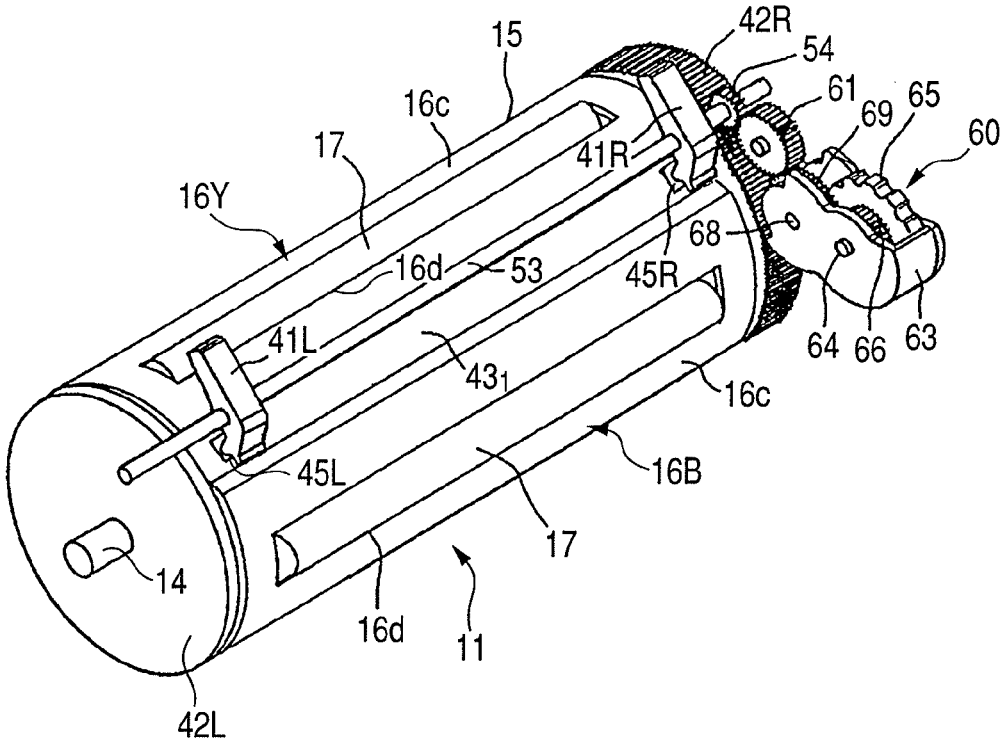
FIG. 8A is a perspective model view illustrating an outward appearance of a developing device.
Figure 8B:
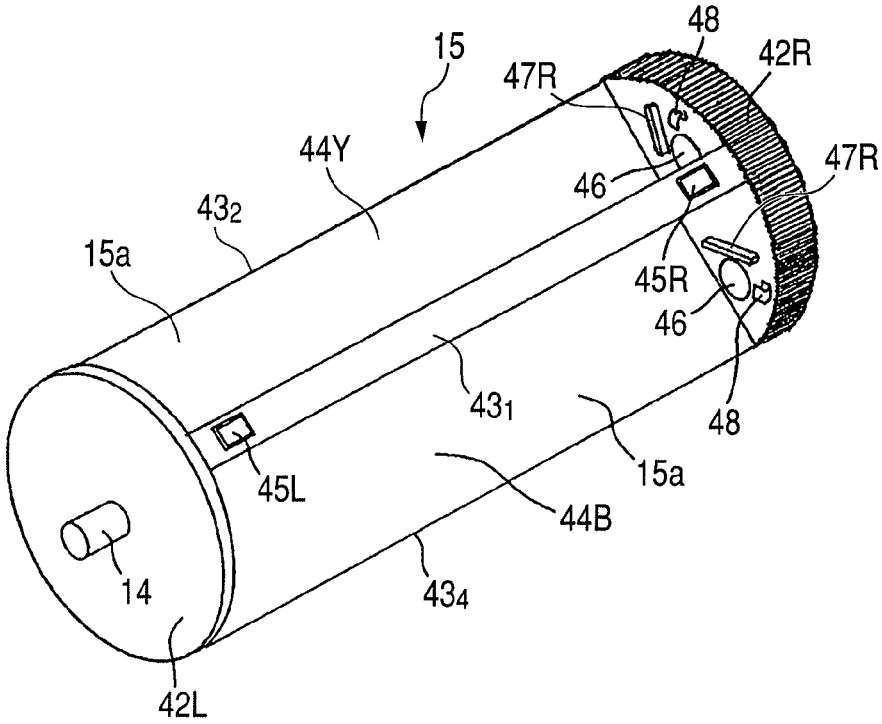
FIG. 8B is a perspective model view illustrating an outward appearance of a rotary.
Figure 9A:
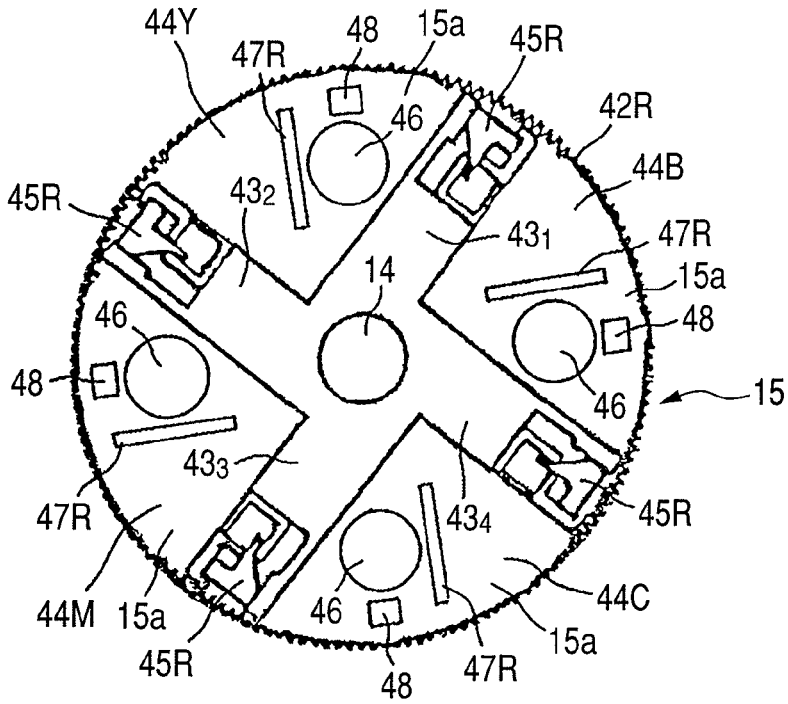
FIG. 9A is an inside view of a right flange on a driving side of the rotary.
Figure 9B:
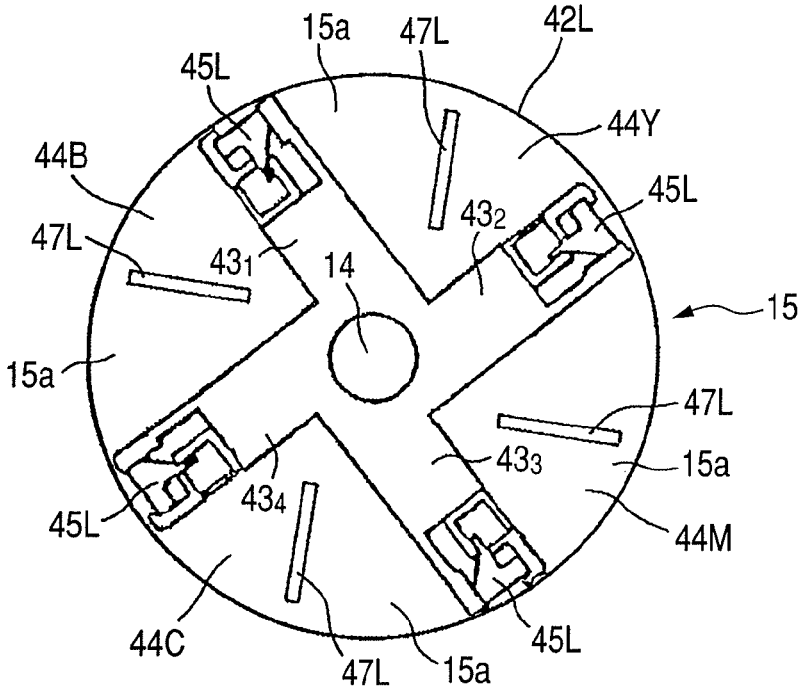
FIG. 9B is an inside view of a left flange on a non-driving side of the rotary.

FIG. 8A is a perspective view illustrating an outward appearance of the developing device 11, and FIG. 8B is a perspective view illustrating an outward appearance of the rotary 15. FIG. 9A is an inside view of the right flange as the driving side of the rotary 15, and FIG. 9B is an inside view of the left flange as the non-driving side.

The rotary 15 is capable of retaining four cartridges, i.e., the first to fourth cartridges 16B, 16Y, 16M and 16C in a substantially columnar manner. Further, the cartridges 16 are mounted to the rotary 15 in an allocation in which intervals of 90° are secured in the rotation direction thereof.

The rotary 15 includes the central shaft 14 which is rotatably bearing-supported between the left frame 5L and the right frame 5R provided in the apparatus main body 5. Further, the rotary 15 includes disk flanges 42L and 42R which are fixedly disposed at the one end side and the other end side of the shaft 14, respectively. The right flange 42R serves as a driving side. Teeth are provided around the right flange 42R so that the right flange 42R constitutes a rotary gear. Four partition plates, i.e., the first to fourth partition plates 43 (431, 432, 433 and 434) are provided between the flanges 42L and 42R and formed in the shape of a substantial cross in cross-section. One of the ends of the partition plates 431, 432, 433 and 434 are fixed to the flange 42L, and the other ends thereof are fixed to the flange 42R. With the four partition plates, four holding portions, i.e., the first to fourth holding portions 44 (44B, 44Y, 44M and 44C) are constructed between the flanges 42L and 42R in an allocation in which intervals of 90° are secured in the circumferential direction of the rotary 15. A space portion formed between the first and fourth partition plates 431 and 434 constitutes the first cartridge holding portion 44B, in which the first developing cartridge 16B is detachably mounted. A space portion formed between the second and first partition plates 432 and 431 constitutes the second cartridge holding portion 44Y, in which the second developing cartridge 16Y is detachably mounted. A space portion formed between the third and second partition plates 433 and 432 constitutes the third cartridge holding portion 44M, in which the third developing cartridge 16M is detachably mounted. A space portion formed between the fourth and third partition plates 434 and 433 constitutes the fourth cartridge holding portion 44C, in which the fourth developing cartridge 16C is detachably mounted. The cartridges 16 are mounted to and detached from (laterally pulled from) the corresponding holding portions 44 by a user in the radiation direction of the rotary 15.

Cartridge engagement members 45L and 45R are provided in the outer side surface of each of the partition plates $\mathbf{43}_1$, $\mathbf{43}_2$, $\mathbf{43}_3$ and $\mathbf{43}_4$ on the one end side and on the other end side thereof, respectively. The cartridge engagement members 45L and 45R are biased by biasing springs (not shown) in the direction for engaging with the cartridges 16 which are held in (mounted to) the holding portions 44.

The flange 42R has portions corresponding to the holding portions 44B, 44Y, 44M and 44C, each of which is provided with a hole portion 46 through which the output portion for cartridge driving (not shown) provided in the apparatus main body 5 is allowed to move between the outside and the inside of the flange 42R. Further, the flange 42R has inner surface portions corresponding to the holding portions 44B, 44Y, 44M and 44C, each of which is provided with a first guiding rib 47R and an intermediate electrical contact 48 for applying the developing bias. The electrical contact 48 has resiliency obtained by a spring member, and resiliently deflects to the driving side. Still further, the guiding rib 47R guides the cartridges 16 when the cartridges 16 are mounted to and detached from the holding portions 44 by a user.

The flange 42L has inner surface portions corresponding to the holding portions 44B, 44Y, 44M and 44C, each of which is provided with a second guiding rib 47L. The guiding rib 47L guides the cartridges 16 in cooperation with the guiding rib 47R when the cartridges 16 are mounted to and detached from the holding portions 44 by a user.

Figure 10A:
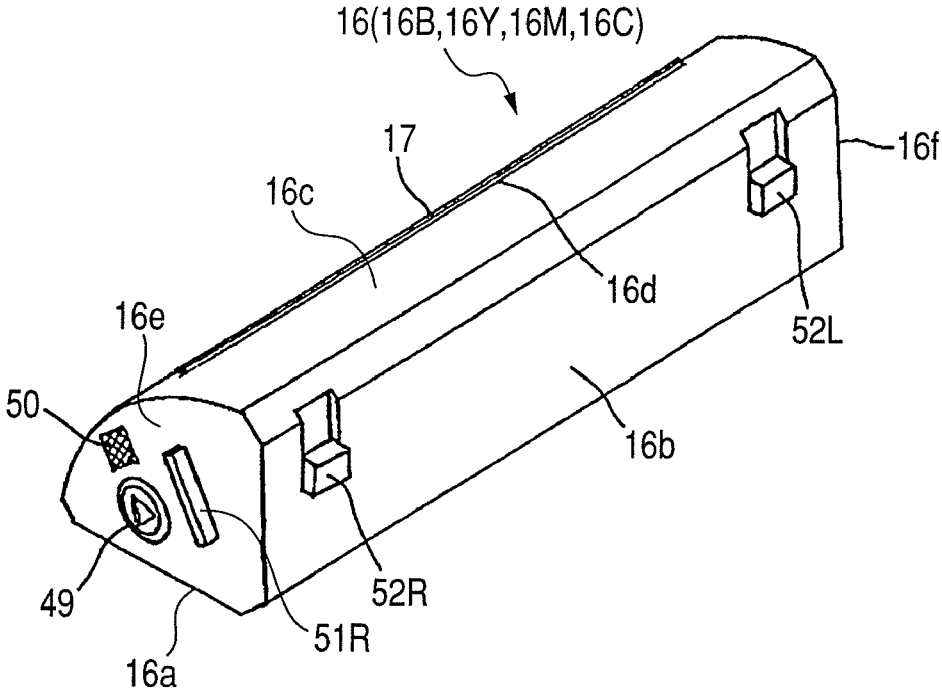
FIG. 10A is a perspective model view illustrating an outward appearance of one of cartridges seen from a driving side thereof.
Figure 10B:
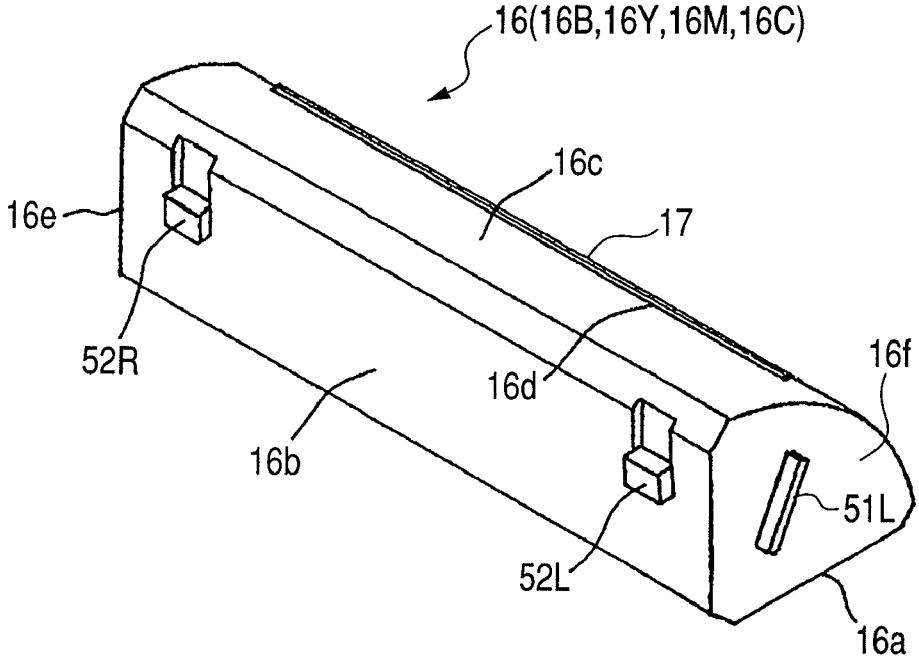
FIG. 10B is a perspective model view illustrating an outward appearance of the one of cartridges seen from a non-driving side thereof.

The cartridges 16B, 16Y, 16M and 16C have the similar shape and structure. FIG. 10A is a perspective view illustrating an outward appearance of one of the cartridges 16 seen from the driving side thereof, and FIG. 10B is a perspective view illustrating an outward appearance seen from the non-driving side thereof.

A cartridge container of the cartridge 16 has a sector shape in cross-section, and has a bottom plate 16*a* and a rear plate 16*b* constituting two surfaces orthogonal to each other, and has a front surface plate 16*c* formed as an arc surface. That is, the cartridge container has a substantially complementary shape to the space portion of the holding portion 44. The developing roller 17 and the developer supply roller 18 for supplying the developer "t" to the developing roller 17 are provided inside the cartridge 16. Further, the developer containing portions 16B1, 16C1, 16M1, and 16Y1 each of which contains the developer "t" are provided inside the cartridges 16. Note that the developing roller 17 has a front surface portion exposed from a slit opening portion 16*d*, which is provided in the front surface plate 16*c* and extends in the longitudinal direction of the cartridge 16. Further, a developing drive input portion 49, a developing bias input electrical contact 50 and a first guided rib 51R are provided on a side surface 16*e* on the driving side of the cartridge 16. A second guided rib 51L is provided on a side surface 16*f* on the non-driving side of the cartridge 16. Further, engaged portions 52L and 52R are provided on the one end side and the other end side of the rear plate 16*b*, respectively. When the cartridge 16 is mounted to and detached from the holding portion 44 by a user, the guided rib 51R and the guided rib 51L are guided by the guiding rib 47R and the guiding rib 47L, respectively. With this structure, the cartridges 16 are smoothly mounted to and detached from the holding portions 44.

In a state in which the cartridges 16 are mounted to the corresponding cartridge holding portions 44 of the rotary 15, the engagement member 45L provided on the one end side of each of the holding portions 44 is engaged with the engaged portion 52L. Further, the engagement member 45R provided on the other end side of each of the holding portions 44 is engaged with the engaged portion 52R. With this structure, the cartridges 16 are prevented from being thrown off from the rotary 15. That is, the cartridges 16 are stably mounted to the holding portions 44, respectively.

In the state in which each of the cartridges 16 is held in the respective holding portions 44, the developing drive input portion 49 corresponds to the hole portion 46 of the right flange 42R. Further, the developing bias input electrical contact 50 is held in contact with the intermediate electrical contact 48 of the right flange 42R. The intermediate electrical contact 48 is resiliently deflected so as to be held in contact with the developing bias input electrical contact 50.

The output portion for cartridge driving (not shown) provided in the apparatus main body 5 is coupled to the developing drive input portion 49 of the cartridge 16 which is moved to the developing position Y by the rotation of the rotary 15. That is, the output portion for driving is plunged into the flange 42R from the outside to the inside thereof through the hole portion 46 so as to be coupled to the developing drive input portion 49. This enables the developing roller 17 and the developer supply roller 18 of the cartridge 16 which is moved to the developing position Y to rotate. Further, the developing bias input electrical contact 50 of the cartridge 16 which is moved to the developing position Y by the rotation of the rotary 15 is electrically connected to the electrical contact (not shown) of the main body through an intermediation of the intermediate electrical contact 48. This makes it possible to apply the developing bias from the power source portion (not shown) provided in the apparatus main body 5 to the cartridge 16 which is moved to the developing position Y.

The output portion for driving (not shown) is coupled to the developing drive input portion 49 of the cartridge 16 which is moved to the developing position Y at the time of image formation. That is, the output portion for driving (not shown) is plunged into the flange 42R from the outside to the inside thereof through the hole portion 46 so as to be coupled to the developing drive input portion 49. Note that the output portion for driving (not shown) is retracted outside the flange 42R in a case where the rotary 15 is located at the standby position X or in a case where the rotary 15 is rotated.

(Rotary Electrically-Driving Mechanism (Rotative Force Transmitting Means))

Figure 11A:
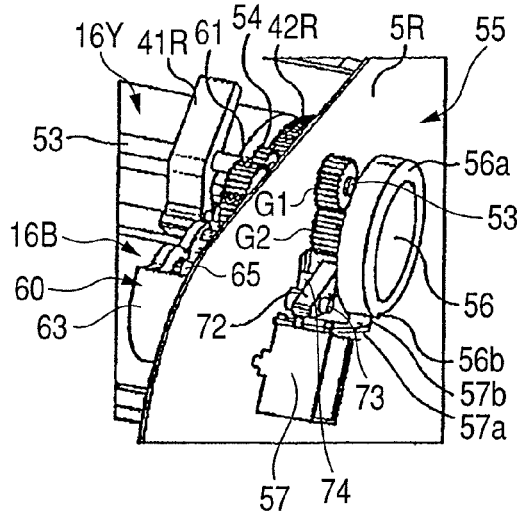
FIGS. 11A, 11B and 11C are explanatory views of a rotary electrically-driving mechanism.
Figure 11B:
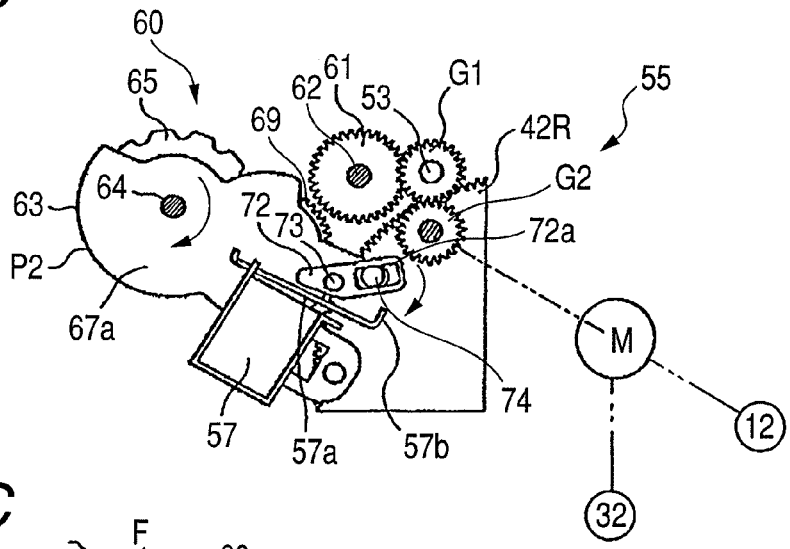
Figure 11C:
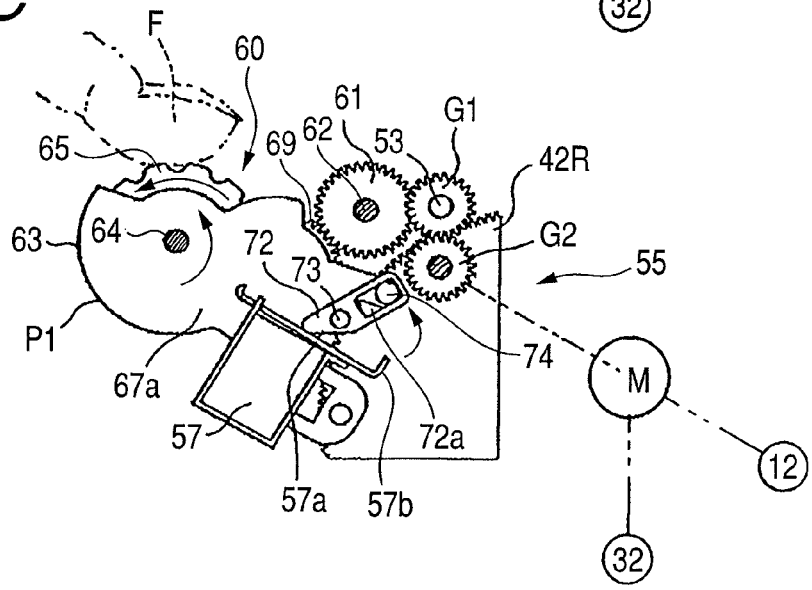

Above the rotary 15, a rotatably bearing-supported drive shaft 53 is arranged between the frame 5L and the frame 5R. The drive shaft 53 is parallel to the rotational axis of the rotary 15. A rotary driving gear 54 which is meshed with the rotary gear (flange 42R) 42R is fixed to the drive shaft 53. Accordingly, in accordance with the rotation of the drive shaft 53, the rotative force is transmitted to the rotary 15 through the gears 54 and 42R. At the time of image formation, the gear 54 is rotated integrally with the drive shaft 53 which is rotated by the rotative force transmitted from the driving mechanism 55 (FIGS. 11A, 11B and 11C) provided outside the frame 5R. Then, the gear 54 transmits the rotative force to the rotary gear 42R provided on the rotary 15. With this structure, the rotary 15 is rotated by the rotative force transmitted from the motor M. The driving mechanism 55 is driving force transmitting means for electrically indexing the rotary 15. FIGS. 11A, 11B and 11C are explanatory views of the driving mechanism (rotative force transmitting means) 55.

The driving mechanism 55 is provided outside the frame 5R (FIG. 11A). The driving mechanism 55 includes a gear train G1, G2, . . . for transmitting the rotative force (driving force) of the motor M to the drive shaft 53, and a one-revolution clutch 56 controlled by a solenoid 57. A control ring 56*a* of the clutch 56 is provided with a cut-away portion 56*b*. A movable lever 57*a* of the solenoid 57 is provided with a distal end claw portion 57*b*.

When the energization of the solenoid 57 is turned OFF, the lever 57*a* is pivoted, by a biasing force of a biasing spring (not shown), in the direction in which the distal end claw portion 57*b* is brought into contact with the control ring 56*a*. That is, the distal end claw portion 57*b* of the lever 57*a* is engaged with the cut-away portion 56*b* of the control ring 56*a*. With this structure, the control ring 56*a* is prevented from being rotated. The rotation of the control ring 56*a* is regulated. In a state in which the rotation of the control ring 56*a* is regulated, the clutch 56 is turned OFF. Therefore, the rotative force is not transmitted from the driving mechanism 55 to the drive shaft 53.

When the solenoid 57 is energized (pulse-energized), the lever 57*a* is pivoted by an electromagnetic force of the solenoid 57 in the direction in which the lever 57*a* is separated from the control ring 56*a* against the spring force of the biasing spring (not shown). This led the distal end claw portion 57*b* to be detached from the cut-away portion 56*b*. That is, the engagement between the distal end claw portion 57*b* and the cut-away portion 56*b* is released. As a result, the stopped rotation of the control ring 56*a* is released. In this state, the clutch 56 is turned ON, and the rotative force is transmitted from the driving mechanism 55 to the drive shaft 53. That is, as a result of the rotation of the drive shaft 53, the rotative force from the motor M is transmitted to the rotary 15 through the intermediation of the gears 54 and 42R. With this structure, the rotary 15 is rotated clockwise as illustrated (by a broken arrow line of FIG. 7) in FIG. 2 about the central shaft 14. In this embodiment, the gear ratio is set such that the rotary 15 is rotated by 45° per one revolution of the control ring 56*a*. With this structure, the rotary 15 is rotated by 90° per two revolutions of the control ring 56*a*.

In this embodiment, the energization of the solenoid 57 is turned ON and OFF on the basis of a predetermined control program of the circuit portion 6. With this structure, the clutch 56 is ON-OFF controlled. In accordance therewith, the rotary 15 is intermittently rotated by 45° or 90°. As a result, with use of the rotary 15, a desired cartridge 16 is accurately moved to the standby position X or the developing position Y so as to be positioned. That is, the solenoid 57 serves as rotational position regulating means for regulating the rotational position of the rotary 15 as a rotary member.

(Cartridge Replacing Type)

The developer "t" contained in each of the developer containing portions 16B1, 16Y1, 16M1 and 16C1 is consumed as the respective cartridges 16B, 16Y, 16M and 16C are used for image formation. In this context, for example, detection means (not shown) for detecting the residual amount of the developer "t" in each of the cartridges 16 is provided to each of the cartridges 16. Then, in the circuit portion 6, the residual amount values detected by the detection means are compared with a threshold which is set in advance for the advance notice of the life end of the cartridge and for the life alarm thereof. Next, the advance notice of the life end or the life alarm of one of the cartridges 16 in which the residual amount value of the developer "t" is decreased to the residual amount value smaller than the threshold is displayed on a display portion 7*a* of the operating portion 7. With this configuration, a user is led to prepare another cartridge 16 to be replaced therefor or led to replace the cartridge 16, whereby the convenience of a user is improved.

Except during the developing operation, the rotary 15 is positioned at the standby position X which is phase-shifted from the developing position Y. Further, a mounting/detaching operation for mounting, replacing and checking the cartridges 16 is performed also at the standby position X.

In the image forming apparatus 1 according to this embodiment, the upper surface of the apparatus main body 5 is provided with the opening portion 3 through which the cartridge 16 is inserted into the apparatus main body 5 and the cartridge 16 is passed for being taken out of the apparatus main body 5. Note that the opening portion 3 is designed as an opening portion through which a user can perform a mounting and detaching operation of a cartridge positioned at a cartridge mounting and detaching position (standby position X). Note that the cartridge mounting and detaching position represents a position at which a cartridge 16 is mounted to a cartridge holding portion 44 or the cartridge 16 is detached from the cartridge holding portion 44. Further, as described above, the cover 2 (openable and closable cover for covering the opening portion 3) is provided as an openable and closable member which is movable between a closing position at which the opening portion 3 is closed and a opening position at which the opening portion 3 is opened. The cover 2 is pivotable with respect to the apparatus main body 5 about the hinge shaft 36 as a center, which is provided on the rear side of the cover 2. In this context, the cover 2 is closed to the apparatus main body 5. (FIGS. 1, 2 and 3 illustrate a state in which the cover 2 is closed.) The opening portion 3 is closed through a closing operation of the cover 2. Further, the cover 2 is pivoted about the hinge shaft 36 as a center to the rear side of the apparatus main body 5. The cover 2 may be opened from the apparatus main body 5. (FIGS. 4, 5 and 6 illustrate a state in which the cover 2 is opened.) With this structure, the opening portion 3 is largely opened. When opening the cover 2 in this state, a user can visually recognize the path portion 37 provided inside the apparatus main body 5 from the opening portion 3. Note that the path portion 37 represents a path through which the cartridges 16 pass when being mounted and detached. That is, in the case of mounting and detaching the cartridges 16, a user can access the cartridges 16 mounted to the rotary 15 by opening the cover 2. That is, in this embodiment, the path portion 37 has one end which leads to the cartridge mounting and detaching position and the other end which is opposed to the opening portion 3. With this structure, a user can easily touch the cartridges 16 mounted to the rotary 15. Therefore, in this embodiment, the mounting and detaching operability of the cartridges 16 may be improved.

As described above, in this embodiment, in the standby state of the image forming apparatus 1, the rotation of the rotary 15 is stopped at the standby position X where the cartridge 16B for black image formation is opposed to the path portion 37. By opening the cover 2, a user can access the cartridge 16B. The cartridge 16B consumes a larger amount of the developer "t" when compared with the cartridges 16 for forming other color images. That is, the cartridge 16B is more frequently replaced when compared with the other cartridges 16C, 16M and 16Y. Accordingly, in this embodiment, in the case of replacing the cartridge 16B, a user can immediately access the cartridge 16B by opening the cover 2. Therefore, it may be said that the usability thereof may be improved.

Further, as described above, with the opening of the cover 2, the state is maintained in which the interlock switch SW of the power supply circuit (not shown) of the apparatus 1 is turned OFF, that is, the power supply circuit is turned OFF. With this configuration, electrical safety is secured.

Still further, with the opening of the cover 2, the engagement releasing members 41L and 41R respectively provided on one end side and the other end side in the longitudinal direction of the rotary 15 are pivoted to the engagement releasing positions. Note that the engagement releasing members 41L and 41R represent acting members with respect to the engagement members 45L and 45R provided on the one end side and the other end side of the rotary 15. In the state in which the rotary 15 is stopped at the standby position X, the engagement releasing members 41L and 41R are arranged at the positions corresponding to the engagement members 45L and 45R which are provided on the one end side and the other end side in the longitudinal direction of the first partition plate 431, respectively. That is, in the state in which the rotary 15 is stopped at the standby position X, the engagement releasing members 41L and 41R are arranged at the positions which are opposed to the engagement members 45L and 45R, respectively. In this embodiment, the engagement releasing members 41L and 41R are loosely engaged with and pivotally supported by the drive shaft 53. Further, the engagement releasing members 41L and 41R are biased clockwise (in the direction indicated by the arrow B in FIG. 6) with use of the biasing spring (not shown).

When the cover 2 is closed, the engagement releasing members 41L and 41R are pressed by the second protruding portions 40L and 40R provided on the backside surface of the cover 2, respectively. That is, the engagement releasing member 41L is pressed by the second protruding portion 40L, and the engagement releasing member 41R is pressed by the second protruding portion 40R. With this structure, the engagement releasing members 41L and 41R are pivoted counterclockwise (in the direction indicated by the arrow A in FIG. 3) against the spring force of the biasing spring (not shown) so as to be maintained at the inoperative position (developing device engagement position) at which the engagement releasing members 41L and 41R are out of contact with the engagement members 45L and 45R.

When the cover 2 is opened, the engagement releasing members 41L and 41R are released from the pressing force in accordance with the retraction of the second protruding portions 40L and 40R. Then, the engagement releasing members 41L and 41R are pivoted clockwise (in the direction indicated by the arrow B in FIG. 6) by the spring force (resilient force) of the biasing spring. By the above-mentioned pivoting of the engagement releasing members 41L and 41R, the engagement members 45L and 45R of the first partition plate $\mathbf{43}_1$ of the rotary 15 stopped at the standby position X are pressed by the engagement releasing members 41L and 41R, respectively. That is, the engagement member 45L is resiliently pressed by the engagement releasing member 41L, and the engagement member 45R is resiliently pressed by the engagement releasing member 41R. Owing to the pressing, the engagement members 45L and 45R are moved to the positions where the engaged portions 52L and 52R of the cartridge 16B are not engaged therewith against the spring force (resilient force) of the return spring (not shown). As described above, the pivotal angular position of each the engagement releasing members 41L and 41R which respectively move the engagement members 45L and 45R is the engagement releasing position.

With the above-mentioned operation, the cartridge 16B positioned at the cartridge mounting and detaching position (standby position X), that is, the cartridge 16B opposed to the path portion 37 is released from engagement with the rotary 15. Further, even when the cartridge 16B is released from engagement with the rotary 15, the first guided rib 51R and the second guided rib 51L are received by the first guiding rib 47R and the second guiding rib 47L, respectively. As a result, the cartridge 16B is stably mounted (held) in the holding portion 44B. Note that the guiding ribs 47L and 47R are provided in the holding portion 44B. In this context, a user reaches into the path portion 37 through the opening portion 3. Then, the user grasps and draws the cartridge 16B from the holding portion 44B to the front side. Further, the cartridge 16B is moved upward in the path portion 37 along the guide plate 38. Then, the cartridge 16B is taken out of the apparatus main body 5 through the opening portion 3. Note that when the cartridge 16B is taken out of the holding portion 44B, the guided rib 51R and the guided rib 51L are guided by the first guiding rib 47R and the second guiding rib 47L, respectively. The rib 51L and the rib 51R are provided at the one end and the other end in the longitudinal direction of the cartridge 16B, respectively. Further, the guiding ribs 47L and 47R are provided inside the holding portion 44B.

In this context, a new cartridge 16B is put into the path portion 37 through the opening portion 3 so as to be moved along the guide plate 38 toward the rotary 15. Then, the cartridge 16B is sufficiently inserted into the holding portion 44B. Note that, when the cartridge 16B is inserted into the holding portion 44B, the rib 51L and the rib 51R are supported by the rib 47L and the rib 47R, respectively.

When it is unnecessary to replace the cartridges other than the cartridge 16B, the cover 2 is then closed.

Note that the above-mentioned mounting and detaching operation of the cartridge 16B with respect to the holding portion 44B is performed by a user.

In response to the closing of the cover 2, the interlock switch SW is turned ON by the first protruding portion 39 so that the power supply circuit (not shown) of the apparatus main body 5 is turned ON. Further, the developing device engagement releasing members 41L and 41R are moved, by the second protruding portions 40L and 40R, to the developing device engagement positions (positions at which they are out of contact with the developing device engagement members 45L and 45R) against the spring force of the biasing spring so as to be retained. As a result, the pressing on the left and right engagement members 45L and 45R of the first partition plate $\mathbf{43}_1$ is released. Then, the engagement members 45L and 45R are returned by the resilient force of the return spring. With this structure, the engagement members 45L and 45R are engaged with the engaged portions 52L and 52R of the brand-new cartridge 16B which is newly held in (mounted to or attached to) the holding portion 44B, respectively. In this manner, the brand-new cartridge 16B is stably held (locked) in the holding portion 44B.

Therefore, when the interlock switch SW is turned ON, all the cartridges 16B, 16Y, 16M and 16C are necessarily locked to the corresponding holding portions 44B, 44Y, 44M and 44C of the rotary 15 by the respective engagement members 45L and 45R. With this structure, it is possible to reliably avoid the trouble that the driving of the apparatus main body 5 is started while the locking of the cartridges with respect to the rotary 15 is failed.

Herein, a case of replacing the cartridge 16B which is most frequently replaced is described in the above-mentioned embodiment. In this case, when the detection means (not shown) for detecting the residual amount of the developer is provided to each of the cartridges 16, the rotary 15 may be stopped while the cartridge whose residual amount of the developer is reduced is moved to the position corresponding to the path portion 37 through control of the circuit portion 6. Further, through control of the circuit portion 6, the advance notice of the life end or the life alarm may be displayed on the display portion 7*a* (FIG. 4). With this configuration, it is possible for a user to immediately access the cartridge to be replaced by opening the cover 2.

(Rotary Manually-Driving Mechanism (Manually-Driving Unit (Manually-Operated Unit)))

Next, means by which a user accesses a plurality of cartridges will be described below. The mounting and detaching of the cartridge stopped at a position other than the position corresponding to the path portion 37 (mounting and detaching position) is performed as follows. That is, the rotary 15 is rotated by a rotary manually-driving mechanism 60 such that the cartridge to be mounted or detached is moved to the position (mounting and detaching position) corresponding to the path portion 37.

The rotary manually-driving mechanism 60 according to this embodiment will be described mainly with reference to FIGS. 12A, 12B, 12C and 13.

Figure 12A:
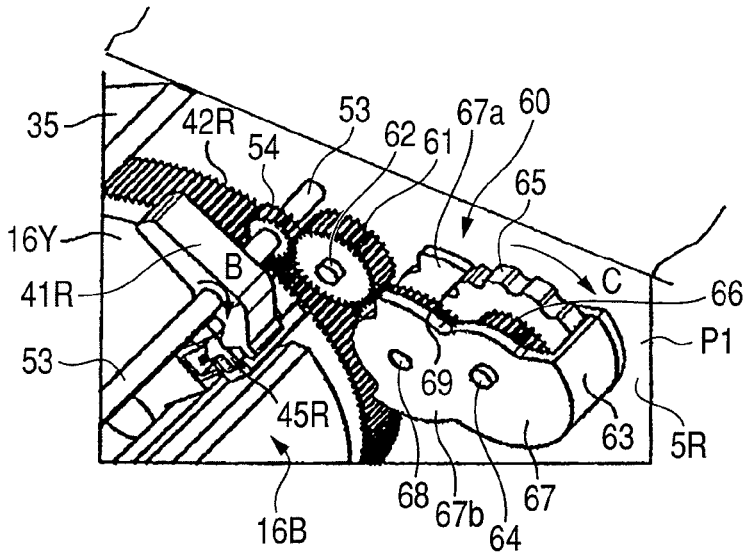
FIGS. 12A, 12B and 12C are explanatory views of a rotary manually-driving mechanism.
Figure 12B:
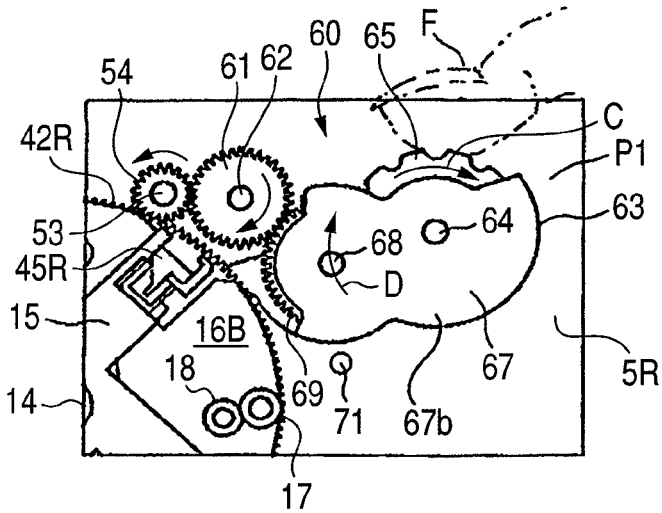
Figure 12C:
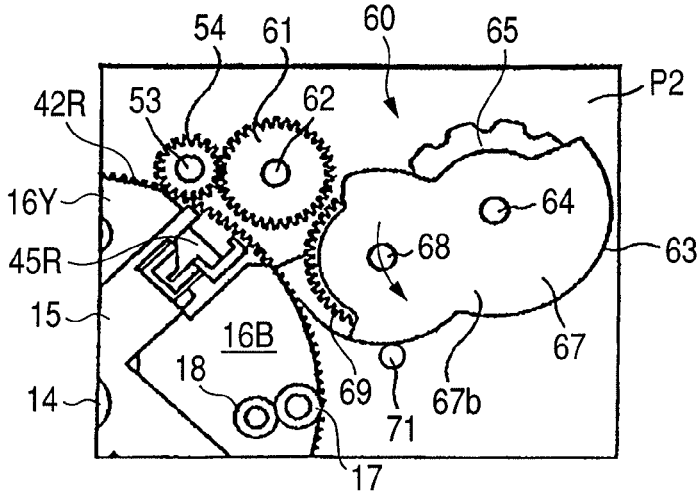
Figure 13:
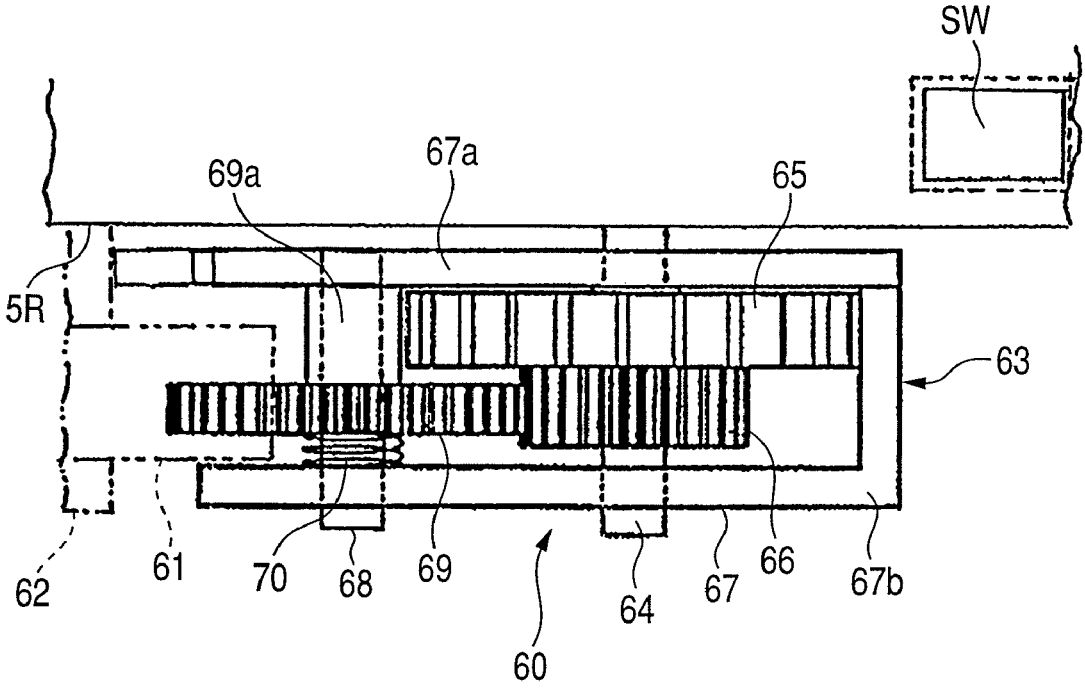
FIG. 13 is a plan view of the rotary manually-driving mechanism.

FIG. 12A is a partial perspective view illustrating a periphery of the manually-driving mechanism 60 in a state in which the first cartridge 16B of the four cartridges is at the mounting and detaching position and the cover 2 is opened. FIG. 12B is a partial sectional view illustrating a state in which a manually-driving unit 63 is held in contact with an intermediate drive transmission gear 61, and FIG. 12C is a partial sectional view illustrating a state in which the manually-driving unit (manually-operated unit) 63 is spaced apart from the intermediate drive transmission gear 61.

Note that the chain double-dashed line of FIG. 12B illustrates a finger of a user who is turning a dial 65.

The manually-driving mechanism 60 is provided in the path portion 37 and on the inner surface side of the right frame 5R provided in the apparatus main body 5. The intermediate drive transmission gear 61 is rotatably provided about a shaft 62 as a center and on the inner surface side of the frame 5R. The gear 61 is meshed with the rotary driving gear 54. The manually-driving unit (manually-operated unit) 63 is provided on the inner surface side of the right frame 5R while being on the side of the gear 61, which is opposite to the side on which the gear 54 is provided. The unit 63 is attached to the right frame 5R pivotally about the shaft 64 as a center. The pivotable unit 63 is movable between a position (operative position P1) at which the unit 63 is engaged (brought into contact) with the gear 61 and a position (retracted position P2) at which the unit 63 is spaced apart from the gear 61. That is, the unit 63 is movable to the operative position P1 (FIGS. 11C, 12A and 12B) at which the unit 63 is connected to the driving mechanism (rotative force transmitting means) 55 so that the rotative force is transmitted to the driving mechanism 55. Further, the unit 63 is movable to the retracted position P2 (FIGS. 11B and 12C) at which the unit 63 is spaced apart from the driving mechanism 55. Note that the driving mechanism 55 transmits the rotative force from the motor M to the rotary (rotary member) 15.

In this embodiment, the fixing unit 32, the intermediate transfer belt unit 12, and the like, in addition to the rotary 15, are driven (rotated) by the rotative force of the motor M. Note that the members to be rotated are not limited thereto, but other members may be rotated.

The unit 63 includes the dial (access member) 65 which is rotatable about the shaft 64 as a center and is manually operated by a user, a dial gear 66 which is provided coaxially and integrally with the dial 65. The dial 65 serves as an access member which may be operated by (is accessible to) a user while the cover 2 is opened. Further, the unit 63 includes a pivotal holder 67 constituted by an inner member 67*a* and an outer member 67*b*, with the dial 65 and the dial gear 66 being interposed therebetween. The holder 67 is rotatable about the shaft 64 as a center. The inner member 67*a* and the outer member 67*b* of the pivotal holder 67 are integrally coupled to each other. Further, between the inner member 67*a* and the outer member 67*b*, a pivotal gear 69 is interposed between the gear 66 and the gear 61. The gear 69 is supported rotatably about a shaft 68 as a center by the holder 67. The pivotal gear 69 is meshed with the dial gear 66. Between the outer member 67*b* and the pivotal gear 69, a compression spring (resilient member) 70 is provided as a rotational resistance giving member. Owing to the spring force (resilient force) of the compression spring 70, the pivotal gear 69 is always biased so as to be moved toward the inner member 67*a*. As a result, the end surface of a boss portion 69*a* of the pivotal gear 69 is held in pressure contact with the inner surface of the inner member 67*a*. Owing to the frictional force generated by the pressure contact, the pivotal gear 69 is subjected to a constant braking force (rotational resistance) against the rotative force transmitted from the dial gear 66. That is, the pivotal gear 69 is subjected to a constant braking force (rotational resistance) during rotation thereof.

As described above, the unit 63 includes the compression spring (rotational resistance giving member) 70. The movement of the unit 63 between the operative position P1 and the retracted position P2 is pivotal movement. Further, the above-mentioned manual operation performed by a user is an operation of rotating the dial (access member) 65 against the load of the spring 70.

In a normal state, the unit 63 is pivoted, owing to its weight balance, around the shaft 64 as a center in the direction in which the side provided with the pivotal gear 69 descends. In this case, the normal state represents a free state, that is, a state in which a user does not perform manual operation of the dial 65 (operation of manually rotating dial 65). In this context, the pivotal holder 67 is supported while the lower surface portion thereof is received by a stopper portion 71 which is provided on the inner surface of the frame 5R (FIG. 12C). In this state, the pivotal gear 69 is at the position (retracted position P2) where the pivotal gear 69 is separated from the gear 61 (rotative force transmitting means). That is, the pivotal gear 69 is at the retracted position P2 where the pivotal gear 69 is retracted from the driving mechanism (rotative force transmitting means) 55.

As described above, the unit (manually-operated unit) 63 is movable between the operative position P1 at which the unit 63 is connected to the driving mechanism (rotative force transmitting means) 55 so that the rotative force is transmitted to the driving mechanism 55, and the retracted position P2 at which the unit 63 is spaced apart from the driving mechanism 55. Specifically, the unit 63 assumes the operative position P1 where the gear 69 of the unit 63 is engaged with the gear 61 of the driving mechanism 55, and the retracted position P2 where the gear 69 is separated from the gear 61. Further, while being moved from the retracted position P2 to the operative position P1 by manual operation of a user, the unit 63 transmits the rotative force to the driving mechanism 55 by manual operation. With this structure, the unit 63 rotates the rotary 15 with use of the manual force of the user. Note that the unit 63 is returned to the retracted position P2 when the user releases his or her hand from the unit.

Further, the unit 63 includes the dial (access member) 65 provided at the position where a user can operate the dial 65 through the opening portion 3.

Still further, when a user manually operates the dial 65 so as to impart an operating force thereto, the unit 63 is moved from the retracted position P2 to the operative position P1 so as to impart a rotative force to the rotary 15. Note that, when the user releases his or her hand from the dial 65, the unit 63 is returned to the retracted position P2.

Further, the pivot center (shaft 64) of the pivotal movement of the unit 63 is aligned with the rotation center (shaft 64) of the dial 65. With this structure, the user's operability of exerting a rotative force on the dial 65 is improved.

When the cover 2 is opened for mounting and detaching of the cartridge 16, the driving mechanism 60 is exposed in the path portion 37. The mounting and detaching process of the first cartridge 16B is performed as described above. The mounting and detaching of the cartridges (16Y, 16M and 16C) other than the cartridge 16B is performed as follows. The rotary 15 is rotated by the manually-driving mechanism 60 such that the cartridge to be detached (replaced) is moved to the position (mounting and detaching position) corresponding to the path portion 37. That is, as illustrated in FIG. 12B, a user puts the user's finger F on the dial 65 to rotate the dial 65 clockwise in the direction indicated by the arrow C about the shaft 64 as a center. Then, the rotative force of the dial 65 is transmitted to the pivotal gear 69 through the dial gear 66. In this case, the pivotal gear 69 is subjected to a constant braking force against the rotative force transmitted from the dial gear 66 by the spring 70 as described above. For that reason, the pivotal holder 67 is pivoted clockwise (in the direction indicated by the arrow D of FIG. 12B) about the shaft 64 as a center to the position at which the pivotal gear 69 is engaged with the gear 61. Then, owing to the engagement of the pivotal gear 69 with the gear 61, the rotative force of the dial 65 is transmitted to the rotary 15 through the dial gear 66, the pivotal gear 69, the gear 61, the rotary driving gear 54, and the rotary gear (right flange) 42R. With this structure, the rotary 15 may be rotated by hand. The rotary 15 is rotated clockwise about the central shaft 14 as a center (FIGS. 5 and 6) by a manual force.

That is, only when a user operates the dial 65 so as to exert an operating force (rotative force) thereon, the unit 63 is moved to the operative position P1 so as to exert a rotative force on the rotary 15. In this embodiment, the unit 63 is pivotally moved between the operative position P1 and the retracted position P2. Further, the unit 63 is operated by the user such that the dial 65 is rotated against the load (frictional force) generated by the compression spring 70 (rotational resistance giving member). In addition, the pivot center of the unit 63 is substantially coincident with the rotation center of the dial 65.

A user rotates and operates the dial 65 until the cartridge 16 to be accessed for replacement reaches the mounting and detaching position corresponding to the path portion 37 so that the rotary 15 is rotated. When the dial 65 is rotated and operated for rotating the rotary 15, the biasing force (resilient force) of the releasing members 41L and 41R in the direction indicated by the arrow B (FIG. 6) is smaller than the rotative force of the rotary 15 which is rotated through the rotational operation of the dial 65 performed by the user. Thus, the releasing members 41L and 41R respectively pressing the engagement members 45L and 45R of the cartridge 16B are pivoted reversely to the direction indicated by the arrow B by the rotated rotary 15 so as to climb onto the outer surface of the following second cartridge 16Y. With this structure, the pressing on the engagement members 45L and 45R for engaging the first developing cartridge 16B with the rotary 15 is released. Thus, owing to the rotation of the rotary 15, the cartridge 16B moved from the mounting and detaching position is locked with respect to the rotary 15. Further, when the rotary 15 is further rotated so that the subsequent second cartridge 16Y reaches the mounting and detaching position, the releasing members 41L and 41R are pivoted in the direction indicated by the arrow B. As a result, the releasing members 41L and 41R respectively press the engagement members 45L and 45R which engage the second cartridge 16Y with the rotary 15. With this structure, the cartridge 16Y is detachable from the rotary 15. In this case, as the releasing members 41L and 41R increase the rotative force of the rotary 15, it is possible to notify the user who manually operates the dial 65 that the subsequent cartridge 16Y has come to the mounting and detaching position. Note that the same is applied in the cases of the third cartridge 16M and the fourth cartridge 16C.

As described above, a user rotates the rotary 15 with the user's manual force so as to move the cartridge 16Y, 16M, or 16C other than the cartridge 16B to the mounting and detaching position for the purpose of replacing it with a new cartridge. The cover 2 is closed after the replacement. In this case, the circuit portion 6 activates the driving mechanism 55 for returning the rotary 15 to the standby position and causing the rotary 15 to enter the standby state. That is, the rotary 15 is rotated and stopped such that the stopped state thereof is maintained in which the first cartridge 16B for black is at a rotational angular position corresponding to the cartridge mounting and detaching path portion 37.

Note that the rotative force transmitting path from the motor M to the rotary 15 is constituted as follows. The motor M→the gear G2→the gear G1→the drive shaft 53→the gear 54→the rotary gear 42R→the rotary 15. Thus, the driving mechanism (rotative force transmitting means) 55 includes the gear G2, the gear G1, the drive shaft 53, the gear 54 and the rotary gear 42R.

Further, the path on which the rotative force is transmitted to the rotary 15 by manual operation of a user is constituted as follows. The dial 65→the gear 66→the gear 69→the gear 61→the gear 54→the rotary gear 42R.

As described above, in this embodiment, through the operation of rotating the dial 65 in the direction indicated by the arrow C (FIG. 12B) by a user, the unit 63 can be moved from the retracted position P2 to the operative position P1. That is, the pivotal gear 69 can be engaged with the gear 61. In addition, through the operation of rotating the dial 65 in the same direction (direction indicated by the arrow C) by the user, the rotary 15 can be rotated through the gear 69 and the gear 61.

As described above, in this embodiment, through a series of operations of turning the dial 65 in the same direction by a user, the retracted unit 63 can be moved to the operative position P1 and the rotary 15 can be rotated.

Therefore, the operability for a user can be significantly increased in this embodiment.

Note that the unit 63 is returned to the retracted position P2 after a user releases the user's hand from the unit. In this context, when the user rotates the dial 65 in the direction reverse to the direction indicated by the arrow C (FIG. 12B) by mistake, the unit 63 is rotated about the shaft 64 in the direction in which the unit 63 is separated from the gear 61. Then, the pivotal gear 69 is separated from the gear 61. Therefore, the rotative force of the dial 65 is not transmitted to the rotary 15.

Further, when the cover 2 is closed, the unit 63 is pivoted about the shaft 64 owing to its weight balance in the direction in which the unit 63 is separated from the gear 61. Therefore, the pivotal gear 69 is separated from the gear 61. Accordingly, even when the rotary driving gear 54 and the gear 61 meshed with the gear 54 are driven by the driving mechanism 55, the rotative force thereof is not transmitted to the unit 63. Therefore, it is possible to prevent the increase in rotational torque of the rotary during image formation and the generation of noise owing to high speed rotation of the pivotal gear 69 subjected to braking.

As described above, the unit (manually-operated unit) 63 is normally at the retracted position P2. Thus, the unit 63 does not become a rotational load when the rotary 15 is rotated by the rotative force of the motor M.

Further, as illustrated in FIGS. 11B and 11C, in the vicinity of the movable lever 57*a* of the solenoid 57, a solenoid releasing lever 72 is provided on the right frame 5R. Note that the lever 72 is rotatable about a shaft 73 provided to the right frame 5R. The lever 72 is provided with an elongated hole 72*a*. A dowel 74 provided on the inner member 67*a* of the holder 67 is fitted into the elongated hole 72*a*.

FIGS. 11B and 11C are partial sectional views illustrating a coupling operation between the unit 63 and the lever 72, and the right frame 5R and the clutch 56 are omitted therein for the sake of convenience in illustration. As illustrated in FIG. 11B, in the normal state in which the pivotal gear 69 is separated from the gear 61, the lever 72 is held at the position separated from the movable lever 57*a* of the solenoid (rotational position regulating means) 57. This is achieved by the lever 72 being pivoted clockwise about the shaft 73 by the dowel 74 fitted into the elongated hole 72*a* provided in the lever 72. Further, as illustrated in FIG. 11C, in the case of manual operation in which the pivotal gear 69 is engaged with (connected to) the gear 61, the lever 72 is pivoted counterclockwise about the shaft 73 as a center. With this structure, the lever 72 presses down the movable lever 57*a* of the solenoid 57. That is, the claw portion 57*b* which is provided on the distal end of the movable lever 57*a* and engaged with the cut-away portion 56*b* of the control ring 56*a* is detached from the cut-away portion 56*b*. In this manner, the stopped rotation of the control ring 56*a* is released. As a result, when the rotary 15 is manually operated, it is possible to release the positional control on the rotary 15 performed by the solenoid 57. That is, in accordance with the movement of the unit 63 to the operative position P1, the regulation on the rotational position of the rotary 15 owing to the solenoid (rotational position regulating member) 57 is released.

In this structure, the motor M is rotated by manual operation. However, the operating force is controllable with reference to the speed reduction ratio of the motor M. Thus, it suffices that the speed reduction ratio of the motor M is controlled such that the operating force may not cause a practical problem.

In the image forming apparatus according to this embodiment described above, a user can move a desired cartridge to the mounting and detaching position (standby position X) by manual operation. Further, when the rotary 15 is rotated by the rotative force of the motor M, the unit 63 used in the manual operation is at a position spaced apart from the driving mechanism (rotative force transmitting means) 55. Therefore, a surplus rotational load is not increased.

Further, merely by exerting a rotative force on the dial (access member) 65 by manual operation, a user can move the unit 63 to the position at which the unit 63 is capable of transmitting the rotative force. Then, the user can rotate the rotary (rotary member) 15 by transmitting the rotative force thereto through the dial (access member) 65.

Still further, in this embodiment, also when the rotary 15 is rotated by the rotative force of the motor M, the rotary 15 may be accurately stopped at a desired position. In addition, during the manual operation, the solenoid (rotational position regulating member) 57 can be released without a special operation by a user.

Next, with reference to FIG. 14, a description will hereinafter be provided of an embodiment in which a motor M1 dedicated to rotation of the rotary 15 is provided. Further, another structure of the driving mechanism (rotative force transmitting means) 55 will be described.

In the above-mentioned embodiment, an example is described in which the rotary 15, the fixing unit 32, and the intermediate transfer belt unit 12 are driven (rotated) by the rotative force of the motor M. Further, in the above-mentioned embodiment, the description is provided of the construction in which the position of the rotary (rotary member) 15 is regulated by the engagement of the solenoid 57 with the clutch (control ring) 56. However, the structure is not limited thereto. As illustrated in FIG. 14, it is also possible to provide the motor M1 dedicated to rotation of the rotary 15. In this case, when a rotative force is transmitted to the rotary 15 by the manually-driving unit (manually-operated unit) 63, it is also possible to provide driving force disconnecting means such as a ratchet mechanism 80 as illustrated in FIG. 14. As the rotary is disconnected from the motor M1 by the ratchet mechanism (driving force disconnecting means) 80, the motor M1 can be prevented from generating heat in accordance with the corotation of the rotary 15 in the manual operation.

By the disconnection of the drive coupling to the motor M1, it is also possible to further reduce an operating force of the manual operation. Further, the torque which is necessary for the rotation of the motor M1 is unstable in some cases. As a countermeasure therefor, the disconnection of the drive coupling also makes it possible to stabilize the operating force of the manual operation.

Figure 15A:
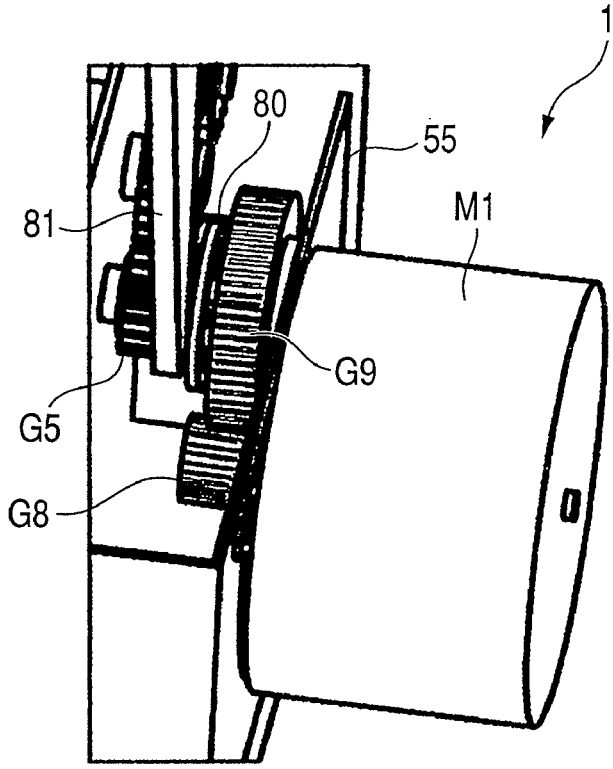
FIGS. 15A and 15B are perspective views illustrating the rotary electrically-driving mechanism (rotative force transmitting means) according to another embodiment of the present invention.
Figure 15B:
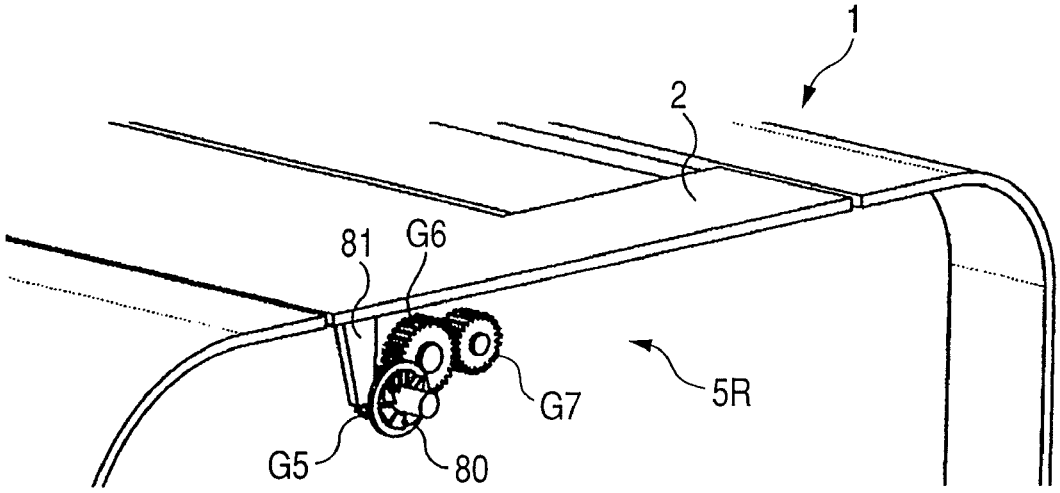

Further, as illustrated in FIGS. 15A and 15B, the driving force disconnecting means may be switched between an operative state and an inoperative state in association with the opening and closing of the cover 2. For example, the ratchet mechanism 80 is in the operative state when the cover 2 is opened, and the coupling to the motor M1 for driving can be disconnected in the manual operation. Then, when the cover 2 is closed, a protruding portion 81 provided on the backside surface of the cover 2 intrudes into a retraction path of the ratchet mechanism 80. As a result, the ratchet mechanism 80 enters an inoperative state. With this structure, irrespective of the rotation direction of the motor M1, the rotary 15 and the motor M1 can be drivingly coupled to each other.

Note that FIGS. 15A and 15B are perspective views illustrating a rotary electrically-driving mechanism (rotative force transmitting means) of a main body side according to another embodiment.

As described above, it is possible to disconnect a part of a series of rotative force transmitting paths between the motor M1 and the driving mechanism (rotative force transmitting means) 55 when the cover 2 is opened. With this structure, the dial 65 is not influenced by the motor M1 when being manually operated by a user. In this case, the rotative force transmitting path is a path for transmitting a rotative force from the motor M1 to the rotary 15.

Figure 14:
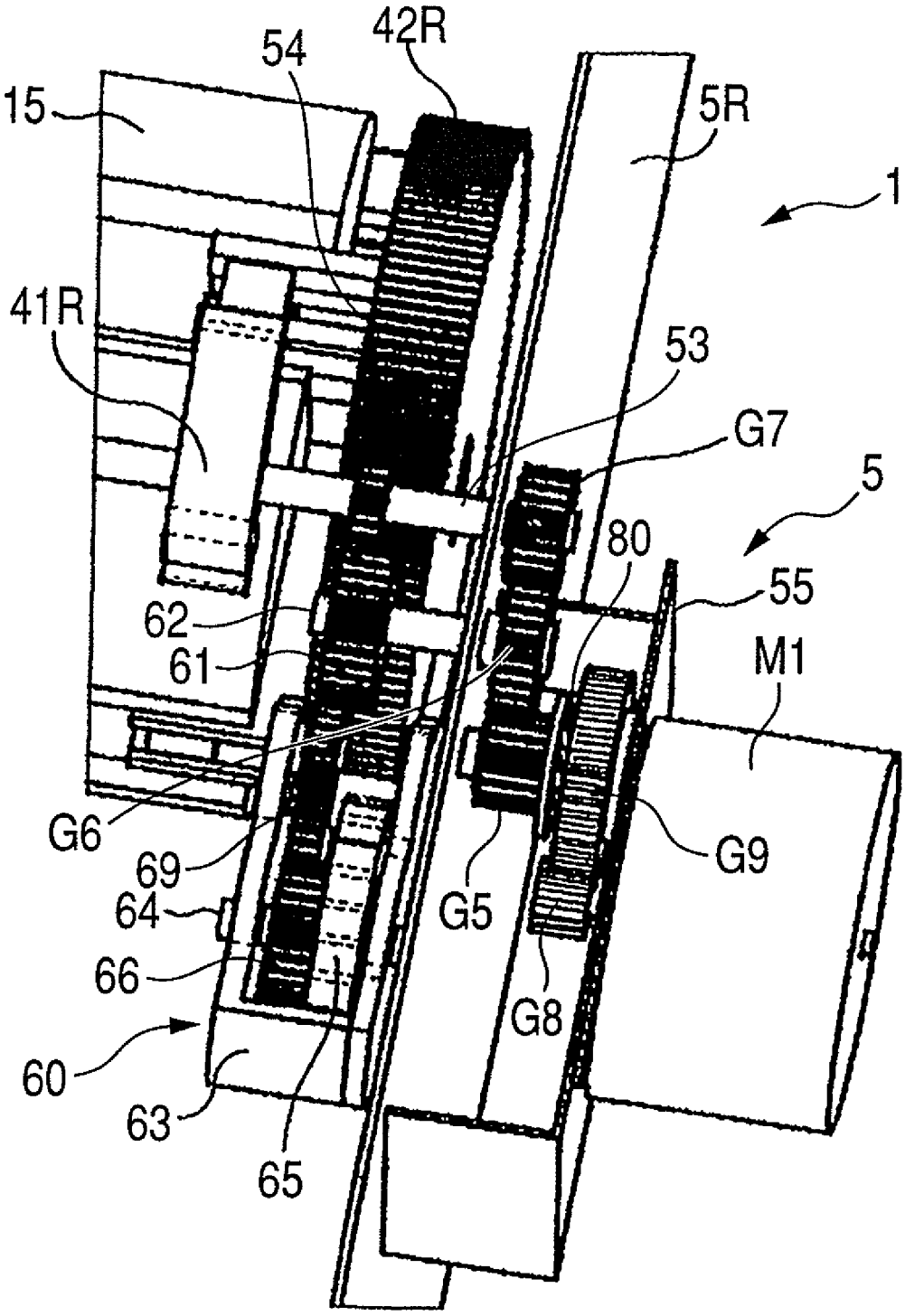
FIG. 14 is a perspective view illustrating a rotary electrically-driving mechanism (rotative force transmitting means) according to another embodiment of the present invention.

Note that, in FIGS. 14 and 15A, the gears G8 and G9 transmit a rotative force from the motor M1 to the gear G5. The gears G8 and G9 constitute a part of the driving mechanism 55. The ratchet mechanism 80 is provided between the gear G9 and the gear G5.

That is, the driving mechanism (rotative force transmitting means) 55 for transmitting a rotative force from the motor M or M1 to the rotary 15 is not limited to a combination of the gear train, the solenoid 57, and the control ring 56*a*. Instead, the driving mechanism may be a combination of the gear train and the ratchet mechanism 80 as illustrated in FIG. 14. Further, for example, a belt, a toothed belt, a crank, a rack, and the like may be used instead of the gears.

(Other Matters)

(1) In this embodiment, the description is provided of the construction in which the pivotal gear 69 of the unit 63 is engaged with and separated from the gear 61, which is engaged with the rotary driving gear 54. However, the invention is not limited to the construction. It is possible to adopt a structure in which the pivotal gear 69 of the unit 63 is engaged with and separated from the rotary driving gear 54. Further, it is also possible to adopt a structure in which the plurality of gears 61 are provided, or a structure in which the pivotal gear 69 is engaged with and separated from the gear train of the driving mechanism 55 which is provided outside the frame 5R.

(2) Further, in this embodiment, the description is provided of the construction in which the dial gear 66 provided integrally with the dial 65 which is operated by a user is meshed with the pivotal gear 69. However, the invention is not limited to the construction. It is also possible to adopt a structure in which a rotative force of the dial 65 is transmitted to the pivotal gear 69 by a belt or the like.

(3) Still further, in this embodiment, the operating portion of the manually-driving mechanism 60 is the dial. However, the invention is not limited to the construction. For example, the operating portion may be a lever biased by a spring in a direction reverse to the operating direction. Then, a gear may be provided coaxially with the lever, and can be coupled to the lever through a ratchet mechanism. As a result, it is also possible to adopt a structure thus obtained in which a rotative force is transmitted to the gear only when a user operates the lever.

(4) Yet further, the following construction may be adopted as another example of the operating portion of the manually-driving mechanism 60. That is, the operating portion may be a rack biased by a spring in a direction reverse to the operating direction. Then, a gear capable of being coupled to the rack is provided. As a result, it is possible to obtain a structure in which a rotative force is transmitted to the gear only when a user operates the operating portion.

(5) Yet further, in this embodiment, the releasing members 41L and 41R are supported by the drive shaft 53 which is provided with the rotary driving gear 54. However, the invention is not limited to the construction. The releasing members 41L and 41R may be supported by another shaft provided separately from the drive shaft 53.

Note that it is probable that a user needs to access a plurality of cartridges at the time of initial installation of an image forming apparatus, for example. In recent years, in order to improve the operability at the time of initial installation of the image forming apparatus, the image forming apparatus is generally packaged and shipped, with the cartridges being mounted in the apparatus main body. However, at the time of initial installation of the image forming apparatus, a user has to access in some cases all the cartridges so as to remove some elements from the cartridges by hand. Examples of the elements include a sealing member for preventing a leakage of toner during transportation and a protection member for preventing the electrical contact portions between the cartridges and the apparatus main body from being chipped. In addition, the user needs to access the plurality of cartridges also in the case of simultaneously replacing the plurality of cartridges and in the case of taking all the cartridges out of the apparatus main body for maintenance.

The structures according to this embodiment are advantageous in the above cases.

According to the above-mentioned embodiments, a user can move a desired developing cartridge to a mounting and detaching position by manual operation.

Further, according to the above-mentioned embodiments, a user can move a desired developing cartridge to a mounting and detaching position by easy manual operation.

Further, according to the above-mentioned embodiments, when a user manually exerts an operational force on a manually-operated unit, the manually-operated unit can be moved from a retracted position to an operative position.

Further, according to the above-mentioned embodiments, when a user manually exerts an operational force on a manually-operated unit, the manually-operated unit is moved from a retracted position to an operative position to exert a rotative force on a rotary member to which a developing cartridge is mounted.

Further, according to the above-mentioned embodiments, as a manually-operated unit normally locates at a retracted position, the manually-operated unit does not cause a load for rotation when a rotary member is rotated by a rotative force of a motor.

Further, according to the above-mentioned embodiments, without a special operation by a user, a manually-operated unit can be moved to a position at which the manually-operated unit is connected to rotative force transmitting means, and an operational force is transmitted to a rotary.

Further, according to the above-mentioned embodiments, during a rotation of a motor, a manually-operated unit does not cause a load for rotation.

Yet further, according to the above-mentioned embodiments, the retracted unit 63 can be moved to the operative position P1 and the rotary 15 can be rotated by a series of operations of turning the dial 65 in the same direction by a user. Therefore, the operability for a user can be significantly increased according to the above-mentioned embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-219387, filed Aug. 28, 2008, which is hereby incorporated by reference herein in its entirety.

What is claimed is:

1. A color electrophotographic image forming apparatus, comprising:

an electrophotographic photosensitive drum;

a motor;

a rotatable rotary member to which a plurality of developing cartridges are detachably mountable, each developing cartridge including: a developer containing portion for containing developer; and a developing roller for developing an electrostatic latent image formed on the electrophotographic photosensitive drum by using the developer contained in the developer containing portion;

rotative force transmitting means for transmitting a rotative force to the rotary member, the rotative force including a motorized rotative force from the motor and a manual rotative force; and a manually-operated unit, which is movable between an operative position in which the manually-operated unit is connected to the rotative force transmitting means to transmit the manual rotative force to the rotative force transmitting means and a retracted position in which the manually-operated unit is spaced apart from the rotative force transmitting means, wherein in a state in which the manually-operated unit is moved from the retracted position to the operative position by manual operation, the manually-operated unit transmits the manual rotative force to the rotative force transmitting means by the manual operation to rotate the rotary member, whereby the rotary member is rotatable by the manual operation, and wherein the manually-operated unit is configured to move from the operative position to the retracted position after the end of the manual operation.

2. A color electrophotographic image forming apparatus according to claim 1, wherein the manually-operated unit comprises an access member provided at a position in which the access member can be operated from an opening portion through which the developing cartridge is mounted and detached from the rotary member.

3. A color electrophotographic image forming apparatus according to claim 2, wherein, when the access member is manually operated to exert an operational force, the manually-operated unit moves from the retracted position to the operative position, whereby the manual rotative force is exerted on the rotary member.

4. A color electrophotographic image forming apparatus according to claim 3, wherein:

the manually-operated unit comprises a rotational resistance giving member;

movement of the manually-operated unit between the operative position and the retracted position is a pivotal movement; and the manual operation is an operation of rotating the access member against a load caused by the rotational resistance giving member.

5. A color electrophotographic image forming apparatus according to claim 4, wherein a pivot center of the pivotal movement of the manually-operated unit coincides with a rotation center of the access member.

6. A color electrophotographic image forming apparatus according to claim 1, further comprising:

an opening portion through which the developing cartridge is mounted and detached from the rotary member; and an openable and closable member for opening and closing the opening portion, wherein, when the openable and closable member is opened, a part of a series of rotative force transmitting paths between the motor and the rotative force transmitting means is disconnected.

7. A color electrophotographic image forming apparatus according to claim 5, further comprising:

an opening portion through which the developing cartridge is mounted and detached from the rotary member; and an openable and closable member for opening and closing the opening portion, wherein, when the openable and closable member is opened, a part of a series of rotative force transmitting paths between the motor and the rotative force transmitting means is disconnected.

8. A color electrophotographic image forming apparatus according to claim 1, wherein the manually-operated unit is configured to be pivotally movable between the operative position and the retracted position, and wherein the manually-operated unit is configured to be pivotally moved from the operative position toward the retracted position owing to a weight balance of the manually-operated unit.

* * * * *